US007690633B2

(12) United States Patent
Tamura et al.

(10) Patent No.: US 7,690,633 B2
(45) Date of Patent: Apr. 6, 2010

(54) SHEET PROCESSING APPARATUS AND IMAGE FORMING APPARATUS INCLUDING STAPLING AND FOLDING MECHANISM

(75) Inventors: Masahiro Tamura, Tokyo (JP); Nobuyoshi Suzuki, Tokyo (JP); Shuuya Nagasako, Ebina (JP); Shohichi Satoh, Yokohama (JP); Akira Kunieda, Tokyo (JP); Tomoichi Nomura, Nagoya (JP); Hiroshi Maeda, Nagoya (JP); Kazuhiro Kobayashi, Kawasaki (JP)

(73) Assignee: Ricoh Co., Ltd., Tokyo (JP)

( * ) Notice: Subject to any disclaimer, the term of this patent is extended or adjusted under 35 U.S.C. 154(b) by 569 days.

(21) Appl. No.: 11/635,043

(22) Filed: Dec. 7, 2006

(65) Prior Publication Data

US 2007/0138726 A1 Jun. 21, 2007

(30) Foreign Application Priority Data

Dec. 16, 2005 (JP) ..... 2005-363629

(51) Int. Cl.
*B65H 37/04* (2006.01)

(52) U.S. Cl. ..... 270/37; 270/32; 270/58.07; 270/58.08; 270/58.09; 270/58.11; 270/58.12; 270/58.17; 270/58.27

(58) Field of Classification Search ..... 270/32, 270/37, 58.07, 58.08, 58.09, 58.11, 58.12, 270/58.17, 58.27
See application file for complete search history.

(56) References Cited

U.S. PATENT DOCUMENTS 6,022,011 A * 2/2000 Hirose ..... 270/37
6,575,446 B2 * 6/2003 Wakabayashi et al. ... 270/58.07
6,910,686 B2 * 6/2005 Awano ..... 270/37
7,293,766 B2 * 11/2007 Ruthenberg et al. ..... 270/37
7,497,425 B2 * 3/2009 Taguchi et al. ..... 270/37
2005/0218579 A1 10/2005 Yamada
2005/0225021 A1 10/2005 Yamada
2006/0038336 A1 * 2/2006 Hirata et al. ..... 270/37
2006/0066022 A1 * 3/2006 Terao et al. ..... 270/58.11
2006/0120306 A1 * 6/2006 Bonal et al. ..... 370/254
2006/0290044 A1 * 12/2006 Taguchi et al. ..... 270/58.08
2007/0108688 A1 * 5/2007 Egawa ..... 270/58.09
2007/0120307 A1 * 5/2007 Izumichi et al. ..... 270/32
2007/0120308 A1 * 5/2007 Takemoto et al. ..... 270/37

FOREIGN PATENT DOCUMENTS

EP 534888 A1 * 3/1993
JP A-06-072064 3/1994
JP A-10-181990 7/1998
JP A-10-250901 9/1998
JP A-2004-195569 7/2004
JP 2003-095527 4/2006

* cited by examiner

*Primary Examiner*—Gene Crawford
*Assistant Examiner*—Leslie A Nicholson, III
(74) *Attorney, Agent, or Firm*—Harness, Dickey & Pierce, P.L.C.

(57) ABSTRACT

A sheet processing apparatus may include a conveyance path and a tray. The conveyance path may convey sheets. The tray may receive the sheets conveyed from the conveyance path. The tray may include a stapler and a folding member. The stapler may staple the sheets. The folding member may fold the stapled sheets and may be provided upstream from the stapler relative to a sheet conveyance direction.

16 Claims, 23 Drawing Sheets

| FIG. 16A |
| --- |
| FIG. 16B |

SHEET PROCESSING APPARATUS AND IMAGE FORMING APPARATUS INCLUDING STAPLING AND FOLDING MECHANISM

PRIORITY STATEMENT

This application claims the priority of Japanese Patent Application No. 2005-363629, filed on Dec. 16, 2005, the disclosure of which is incorporated herein in its entirety by reference.

BACKGROUND

1. Technical Field

Example embodiments of the present invention generally relate to a sheet processing apparatus and an image forming apparatus including a stapling and folding mechanism, e.g., for stapling and folding sheets.

2. Description of Background Art

A background image forming apparatus forms an image on a recording medium (e.g., sheets). The sheets bearing the image may be sent to a sheet processing apparatus for performing processing on the sheets, for example, stapling and folding.

One example of a background sheet processing apparatus includes a staple tray and a fold tray. The staple tray includes an edge stapler and a center stapler. The edge stapler is provided in a lower portion of the staple tray and staples sheets at a position on an edge portion of the sheets. The center stapler is provided in a center portion of the staple tray and staples sheets at a position along the center line of the sheets in a sheet conveyance direction. Sheets sent from the image forming apparatus may be stapled either by the edge stapler or the center stapler. When the center stapler staples the sheets, the fold tray folds the sheets stapled by the center stapler along the center line of the sheets in the sheet conveyance direction to bind the sheets into a magazine.

A stapler moving motor, which is rotatable back and forth, may drive the edge stapler via a timing belt. The edge stapler may move in a direction perpendicular to the sheet conveyance direction to staple sheets at a staple position on an edge portion of the sheets. A stapler sensor may be provided in one end of a moving area of the edge stapler and detects the home position of the edge stapler. The staple position in the direction perpendicular to the sheet conveyance direction may be identified based on a distance for which the edge stapler moves from the home position.

The staple tray may further include an edge fence, a tapper, jogger fences, and a discharging belt. When sheets are delivered into the staple tray, the foremost edges of the sheets in the sheet conveyance direction may touch the edge fence and stop. The tapper may tap the tail edges of the sheets in the sheet conveyance direction. Thus, the sheets may be aligned in the sheet conveyance direction. The jogger fences move to contact the side edges of the sheets to align the sheets in the direction perpendicular to the sheet conveyance direction. The center stapler may include two staplers. The two staplers may be provided symmetrically with respect to the center line of the sheets in the direction perpendicular to the sheet conveyance direction in a manner that a distance from the edge fence to a staple position is greater than half a length of the maximum size sheet that the sheet processing apparatus can handle in the sheet conveyance direction. The discharging belt may include a discharging hook. When the sheets are aligned, the discharging belt may be driven and the rotating discharging belt may move the discharging hook attached thereto upward. The discharging hook may contact the foremost edges of the sheets contacting the edge fence and lift the sheets up to a position at which the center line of the sheets in the sheet conveyance direction is placed at the staple position of the center stapler. The center stapler may staple the sheets at the staple position. The stapled sheets may be sent to the fold tray where the stapled sheets are folded along the center line of the sheets in the sheet conveyance direction.

As described above, in a background sheet processing apparatus, the staple tray may include both the edge stapler and the center stapler. Namely, sheets may be stapled at a position on an edge portion or along the center line of the sheets in the sheet conveyance direction in the common staple tray. The maximum number of sheets which can be stapled by the center stapler may be limited to about 20 sheets because the fold tray can fold up to about 20 sheets. When sheets are stapled at a position along the center line of the sheets in the sheet conveyance direction, the sheets may be curled or buckled more easily than when the sheets are stapled at a position on an edge portion of the sheets. Therefore, in the center stapler, a clincher and a driver may be spaced by about 15 mm away from each other. As a result, the maximum number of sheets which can be stapled by the edge stapler may be limited to about 50 sheets because more than 50 sheets cannot be properly conveyed in the space between the clincher and the driver. For example, the sheets may block the space and thereby may be jammed.

When the clincher and the driver are spaced farther away from each other so that 100 sheets, for example, can be conveyed in the space between the clincher and the driver to increase the maximum number of sheets which can be stapled by the edge stapler, the sheets may be curled or buckled and thereby the center stapler may not staple the sheets at a position along the center line of the sheets in the sheet conveyance direction with a desired accuracy.

SUMMARY

At least one embodiment of the present invention may provide a sheet processing apparatus that includes a conveyance path and a tray. The conveyance path may convey sheets. The tray may receive the sheets conveyed from the conveyance path. The tray may include a stapler and a folding member. The stapler may staple the sheets. The folding member may fold the stapled sheets and may be provided upstream from the stapler relative to a sheet conveyance direction.

At least one embodiment of the present invention may provide an image forming apparatus that includes a first conveyance path and a sheet processing apparatus. The first conveyance path may convey sheets. The sheet processing apparatus may include a second conveyance path and a tray. The second conveyance path may further convey the sheets conveyed from the first conveyance path. The tray may receive the sheets conveyed from the second conveyance path. The tray may include a stapler and a folding member. The stapler may staple the sheets. The folding member may fold the stapled sheets and may be provided upstream from the stapler relative to a sheet conveyance direction.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
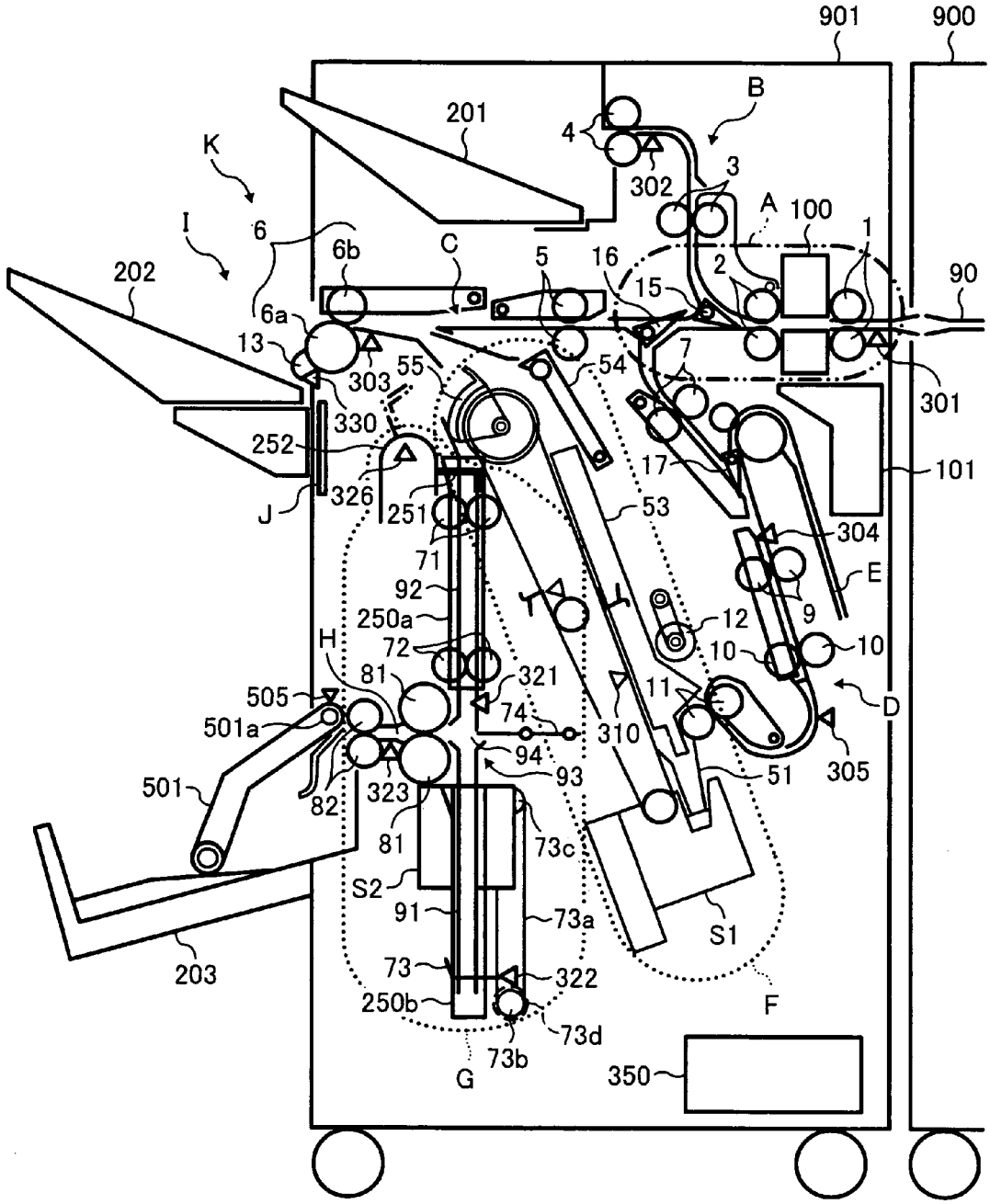
FIG. 1 is a schematic view of a sheet processing apparatus and an image forming apparatus according to an example embodiment of the present invention.

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, a sheet processing apparatus 901 connected with an image forming apparatus 900 according to an example embodiment of the present invention is explained.

As illustrated in FIG. 1, the sheet processing apparatus 901 may be separately provided from the image forming apparatus 900 and may optionally be connected with the image forming apparatus 900. However, the sheet processing apparatus 901 may be included in the image forming apparatus 900. The image forming apparatus 900 may be a copying machine, a printer, a facsimile machine, a multifunction printer having copying, printing, scanning, and facsimile functions, or the like, which forms an image on a recording medium (e.g., a sheet). Types of recording medium other than, or in addition to, paper can be used. According to an example embodiment, the image forming apparatus 900 forms an image on a sheet by an electrophotographic method. However, the image forming apparatus 900 may form an image on a sheet by an inkjet method, a thermal transfer method, or the like.

The image forming apparatus 900 may include an image forming mechanism (not shown) and/or a conveyance path 90. The image forming mechanism forms a toner image on a sheet. The image forming mechanism may include an image processing circuit (not shown), an optical writer (not shown), a photoconductor (not shown), a development unit (not shown), a transferor (not shown), and/or a fixing unit (not shown). The image processing circuit may convert image data created by scanning an image on an original sheet or sent from an information processing apparatus (e.g., a personal computer) into print data, and sends an image signal according to the print data to the optical writer. The optical writer may emit light onto the photoconductor according to the image signal to form an electrostatic latent image on the photoconductor. The development unit may develop the electrostatic latent image with a toner to form a toner image on the photoconductor. The transferor may transfer the toner image onto a sheet. The fixing unit may fix the toner image on the sheet. The conveyance path 90 may convey the sheet bearing the fixed toner image to the sheet processing apparatus 901.

The sheet processing apparatus 901 may be attached to one side of the image forming apparatus 900. The sheet processing apparatus 901 may perform processing (e.g., punching, aligning, stapling, folding, shifting, and the like) on sheets sent from the image forming apparatus 900.

As illustrated in FIG. 1, the sheet processing apparatus 901 may include conveyance paths A, B, C, D, and H, an upper tray 201, a shift tray output section I, a holder E, an edge-stapling tray F, a center-stapling tray G, an axis 501*a*, a lever 501, a sheet sensor 505, a lower tray 203, and/or a controller 350.

The conveyance path A may include an entrance sensor 301, an entrance roller pair 1, a punch unit 100, a waste hopper 101, a conveying roller pair 2, and/or branch nails 15 and 16. The conveyance path B may include a conveying roller pair 3, an upper tray output sensor 302, and/or an upper tray output roller pair 4. The conveyance path C may include a conveying roller pair 5. The shift tray output section I includes a shift tray 202, a shift mechanism J, and/or a lift-lower mechanism K. The lift-lower mechanism K may include a shift tray output roller pair 6, a roller 13, a sheet sensor 330, and/or a shift tray output sensor 303. The shift tray output roller pair 6 may include a driving roller 6*a* and/or a driven roller 6*b*. The conveyance path D may include a conveying roller pair 7, a branch nail 17, a pre-stack sensor 304, conveying roller pairs 9 and 10, a stapler output sensor 305, and/or an output roller pair 11. The edge-stapling tray F may include a tail edge fence 51, a roller 12, a sheet sensor 310, jogger fences 53, a stapler S1, a branch guide 54, and/or a movable guide 55. The center-stapling tray G may include a fold mechanism 93, an upper guide 92, a lower guide 91, a sheet conveyance path 94, an upper roller pair 71, a lower roller pair 72, upper jogger fences 250*a*, lower jogger fences 250*b*, a stapler S2, an edge fence 73, a timing belt 73*a*, a driving pulley 73*b*, a driven pulley 73*c*, a stepping motor 73*d*, a tapper 251, a timing belt 252, and/or a tapper sensor 326. The fold mechanism 93 may include a fold plate 74, fold roller pairs 81 and 82, and/or sheet sensors 321, 322, and 323.

The conveyance path A may be connected to the conveyance path 90 of the image forming apparatus 900 and convey a sheet sent from the image forming apparatus 900 toward the conveyance path B, C, or D. In the conveyance path A, the branch nail 15 may move to guide the sheet toward the conveyance path B or one of the conveyance paths C and D. The branch nail 16 may be disposed on a downstream side from the branch nail 15 relative to a sheet conveyance direction and move to guide the sheet toward the conveyance path C or D. The conveyance path B may convey the sheet toward the upper tray 201. The conveyance path C may convey the sheet toward the shift tray output section I. The conveyance path D may convey the sheet toward the edge-stapling tray F.

The conveyance path A may be disposed upstream from the conveyance paths B, C, and D relative to the sheet conveyance direction. In the conveyance path A, the entrance sensor 301, the entrance roller pair 1, the punch unit 100, the waste hopper 101, the conveying roller pair 2, the branch nail 15, and the branch nail 16 may be sequentially arranged in the sheet conveyance direction. The entrance sensor 301 may detect a sheet sent from the image forming apparatus 900. The entrance roller pair 1 may feed the sheet toward the punch unit 100. The punch unit 100 may punch holes in the sheet. The waste hopper 101 may receive punch waste generated by a punching operation of the punch unit 100. The conveying roller pair 2 may feed the sheet toward the branch nails 15 and 16. Springs (not shown) may constantly bias the branch nails 15 and 16 to the positions illustrated in FIG. 1. When solenoids (not shown) are turned on, the branch nail 15 may rotate upward and the branch nail 16 may rotate downward.

For example, to guide the sheet toward the conveyance path B, the solenoid assigned to the branch nail 15 may be turned off to hold the branch nail 15 at the position illustrated in FIG. 1. To guide the sheet toward the conveyance path C, the solenoids assigned to the branch nails 15 and 16 may be turned on to rotate the branch nails 15 and 16 upward and downward, respectively. To guide the sheet toward the conveyance path D, the solenoid assigned to the branch nail 15 may be turned on to rotate the branch nail 15 upward and the solenoid assigned to the branch nail 16 may be turned off to hold the branch nail 16 at the position illustrated in FIG. 1.

When the sheet is conveyed to the conveyance path B, the conveying roller pair 3 may feed the sheet guided by the branch nail 15 toward the upper tray output roller pair 4. The upper tray output sensor 302 may be disposed upstream from the upper tray output roller pair 4 relative to the sheet conveyance direction and may detect the sheet fed by the conveying roller pair 3. The upper tray output roller pair 4 may feed the sheet onto the upper tray 201. The upper tray 201 may receive the sheet.

When the sheet is conveyed to the conveyance path C, the conveying roller pair 5 may feed the sheet toward the shift tray output roller pair 6 of the shift tray output section I.

The shift tray output section I may output the sheet so that a user can pick up the sheet.

When the sheet is conveyed to the conveyance path D, the conveying roller pair 7 may feed the sheet fed from the conveyance path A toward the conveying roller pair 9. A low-load spring (not shown) may be used to hold the branch nail 17 at the position illustrated in FIG. 1. When the tail of the sheet passes the branch nail 17, at least one of the conveying roller pairs 9 and 10 and the output roller pair 11 (e.g., at least the conveying roller pair 9) may reverse its rotating direction to feed the sheet toward the holder E. The holder E may hold the sheet fed by the conveying roller pair 9, for example, when the stapler S1 staples the previous sheet stack and thereby the previous sheet stack may occupy the edge-stapling tray F. Thus, the sheet may be conveyed together with the next sheet fed to the holder E. This operation may be repeated to convey two or more sheets together. The pre-stack sensor 304 and the stapler output sensor 305 may detect the sheet.

The edge-stapling tray F may align and staple sheets at a position on an edge portion of the sheets. When sheets are conveyed to the edge-stapling tray F, the tail edge fence 51 may contact and align the sheets in the sheet conveyance direction. The roller 12 may align the sheets in the sheet conveyance direction. The sheet sensor 310 may detect whether or not a sheet is placed in the edge-stapling tray F. The jogger fences 53 may align the sheets in a direction perpendicular to the sheet conveyance direction based on the detection result output by the sheet sensor 310. The stapler S1 may staple the aligned sheets at a position on an edge portion of the sheets. The branch guide 54 and the movable guide 55 may guide the stapled sheets toward the conveyance path C or the center-stapling tray G.

The center-stapling tray G may align sheets, and staple and fold the sheets at a position along the substantially center line (e.g., on or in the vicinity of the center line) of the sheets in the sheet conveyance direction. When sheets are conveyed to the center-stapling tray G, the center-stapling tray G may align, staple, and/or fold the sheets, and convey the folded sheets toward the conveyance path H. The conveyance path H may convey the folded sheets toward the lower tray 203. The lower tray 203 may receive the folded sheets.

The axis 501*a* may swingably support the lever 501. The lever 501 may contact an uppermost sheet of the folded sheets output onto the lower tray 203. The sheet sensor 505 may detect the angle of the lever 501 to control operations for lifting and lowering the lower tray 203 and to detect an overload of the lower tray 203.

The controller 350 may control operations of the sheet processing apparatus 901.

Figure 2:
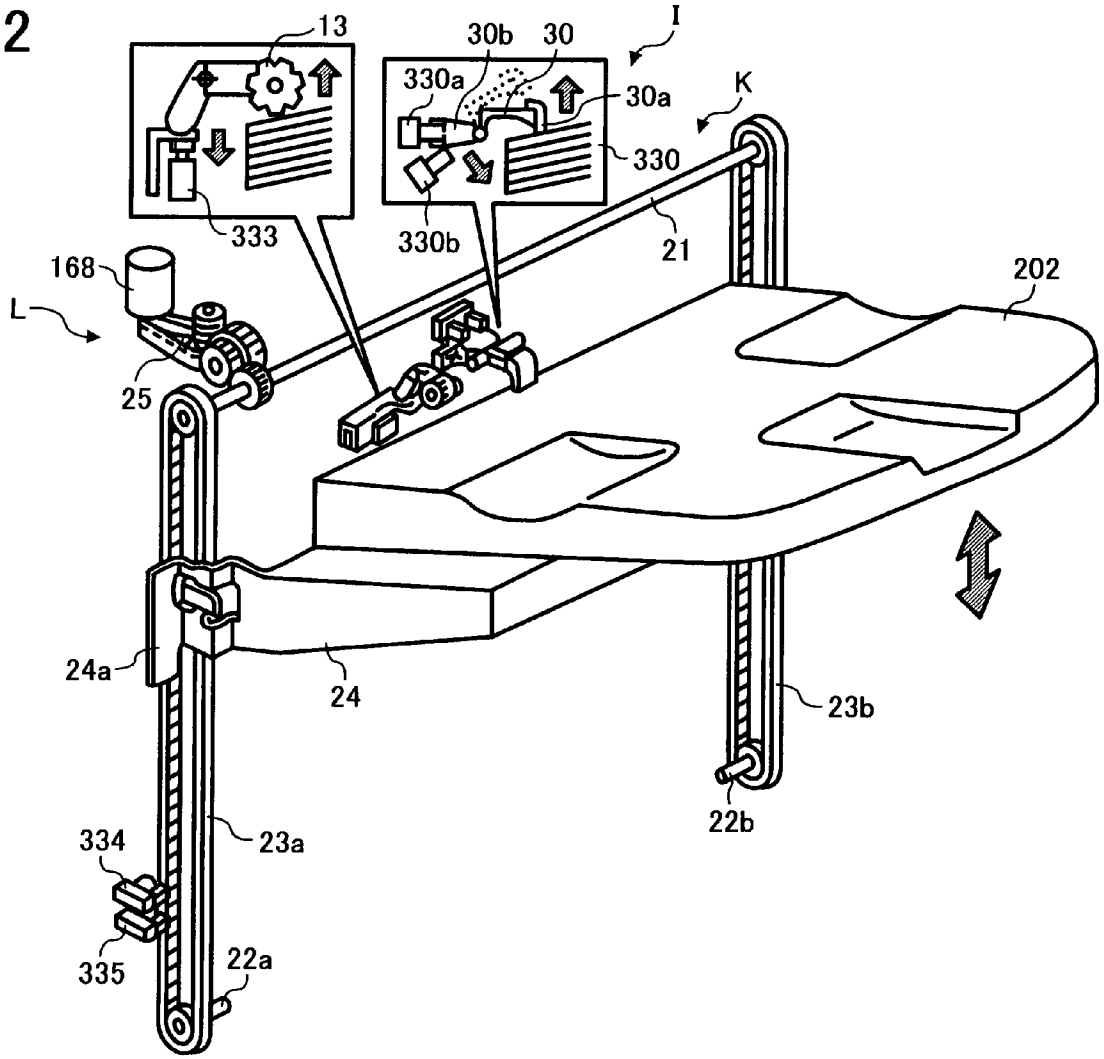
FIG. 2 is a perspective view (according to an example embodiment of the present invention) of a lift-lower mechanism of the sheet processing apparatus shown in FIG. 1.
Figure 3:
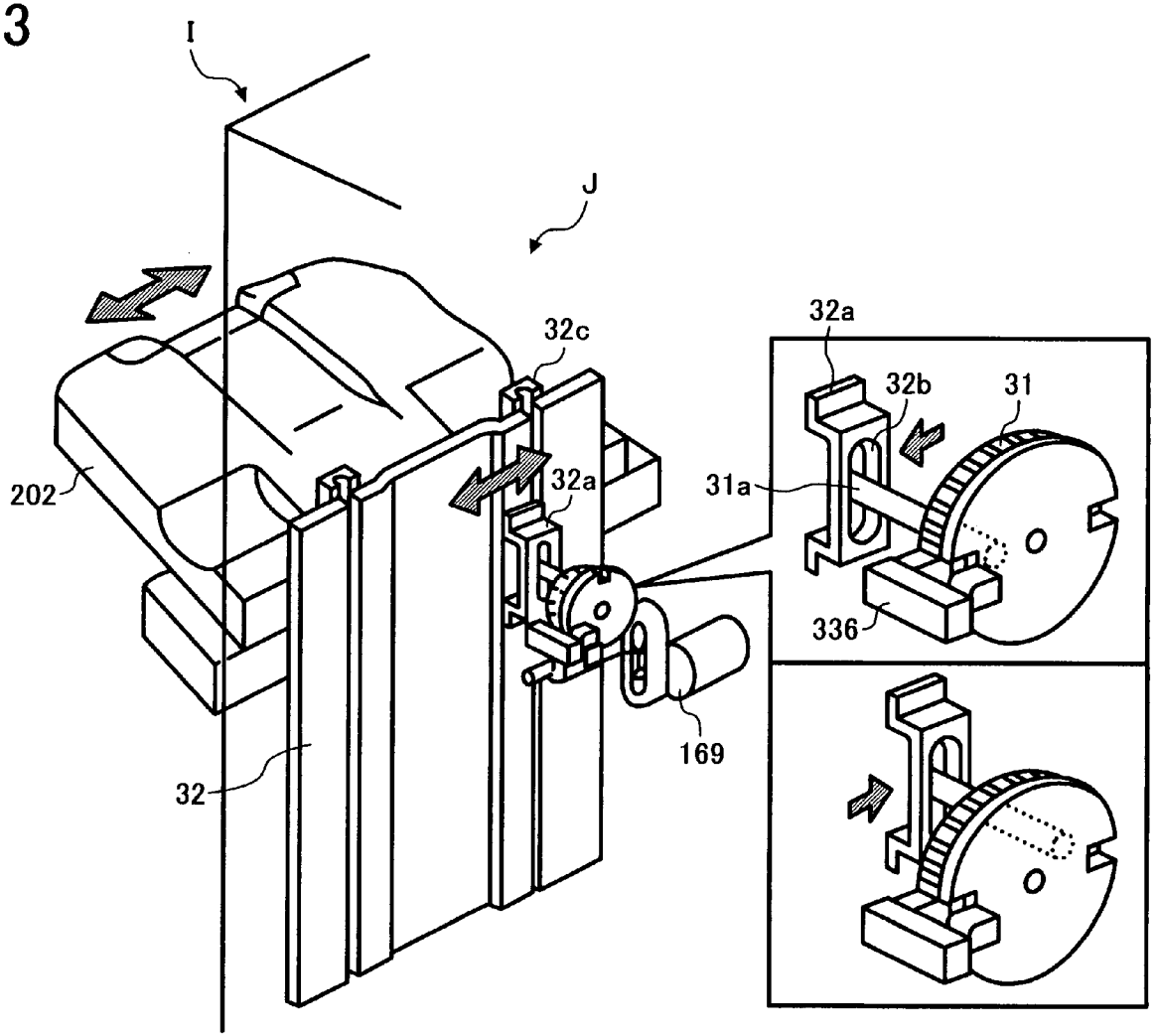
FIG. 3 is a perspective view (according to an example embodiment of the present invention) of a shift mechanism of the sheet processing apparatus shown in FIG. 1.

Referring to FIGS. 1 to 3, the following describes the shift tray output section I. As illustrated in FIG. 2, the lift-lower mechanism K may further include a limit switch 333, a driving unit L, a driving shaft 21, driven shafts 22*a* and 22*b*, timing belts 23*a* and 23*b*, a side plate 24, a shield plate 24*a*, a full-load sensor 334, and/or a lower limit sensor 335. The driving unit L may include a tray moving motor 168 and/or a worm gear 25. The sheet sensor 330 may include a lever 30, a stapled sheet sensor 330*a*, and/or a non-stapled sheet sensor 330*b*. The lever 30 may include a contact portion 30*a* and/or a shield portion 30*b*. In FIG. 2, the shift tray output roller pair 6 is not shown.

As illustrated in FIG. 3, the shift mechanism J may include an end fence 32, a shift motor 169, a shift cam 31, a pin 31*a*, an engaging member 32*a*, a shift tray sensor 336, and/or a guide 32*c*. The engaging member 32*a* may include a hole 32*b*.

As illustrated in FIG. 1, the shift tray output section I may be disposed furthest downstream of the sheet processing apparatus 901 in the sheet conveyance direction. The shift mechanism J may shift the shift tray 202. The lift-lower mechanism K may lift and lower the shift tray 202. The shift tray output sensor 303 may detect a sheet sent from the conveyance path C. The shift tray output roller pair 6 may rotate to feed the sheet sent from the conveyance path C onto the shift tray 202.

For example, the driven roller 6*b* may contact the driving roller 6*a* by its own weight or by a force applied to the driven roller 6*b*. The driving roller 6*a* and the driven roller 6*b* may feed a sheet while nipping the sheet. The shift tray 202 may receive the sheet fed by the driving roller 6*a* and the driven roller 6*b*. The rotating driving roller 6*a* may rotate the roller 13. The roller 13 may include a sponge. The rotating roller 13 may contact the tail of the sheet output on the shift tray 202 and cause the sheet to touch the end fence 32 (depicted in FIG. 3). Thus, the sheet may be aligned on the shift tray 202. The sheet sensor 330 may be disposed near the roller 13 and detect the sheet output on the shift tray 202.

As illustrated in FIG. 2, the limit switch 333 may be disposed near the roller 13. When the shift tray 202 is lifted and pushes up the roller 13, the limit switch 333 may be turned on to stop the tray moving motor 168 so as to prevent the shift tray 202 from overrunning.

The lever 30 may rotate around its shaft (not shown). The contact portion 30*a* may contact the tail of the top surface of the sheet output on the shift tray 202. The shield portion 30*b* may have a fan-like shape and shield the stapled sheet sensor 330*a* and the non-stapled sheet sensor 330*b*. The stapled sheet sensor 330*a* may be disposed above the non-stapled sheet sensor 330*b*. The stapled sheet sensor 330*a* may be used for controlling output of stapled sheets. The non-stapled sheet sensor 330*b* may be used for controlling output of shifted sheets.

The stapled sheet sensor 330*a* and the non-stapled sheet sensor 330*b* may be turned on when shielded by the shield portion 30*b*. For example, when the shift tray 202 is lifted and the contact portion 30*a* rotates upward, the stapled sheet sensor 330*a* may be turned off. When the contact portion 30*a* further rotates, the non-stapled sheet sensor 330*b* may be turned on. When the stapled sheet sensor 330*a* and the non-stapled sheet sensor 330*b* detect a condition in which the top surface of the uppermost sheet of sheets stacked on the shift tray 202 reaches a reference height, the tray moving motor 168 may be driven to lower the shift tray 202 by a reference distance. Thus, the top surface of the uppermost sheet on the shift tray 202 may be maintained at a substantially constant height.

Referring to FIG. 2, the following describes the lift-lower mechanism K. The driving unit L may drive the driving shaft 21. The timing belt 23*a* may be looped over the driving shaft 21 and the driven shaft 22*a* with tension via timing pulleys (not shown). The timing belt 23*b* may be looped over the driving shaft 21 and the driven shaft 22*b* with tension via timing pulleys (not shown). The rotating driving shaft 21 may rotate the timing belts 23*a* and 23*b*. The rotating timing belts 23*a* and 23*b* may rotate the driven shafts 22*a* and 22*b*, respectively. The side plate 24 may be fixed to the timing belts 23*a* and 23*b* and support the shift tray 202. Thus, the timing belts 23*a* and 23*b* may support and move the shift tray 202 upward and downward.

The rotating direction of the tray moving motor 168 may be reversed. To move the shift tray 202 upward and downward, a driving force generated by the tray moving motor 168 may be transmitted to the last gear of a row of gears arranged from the worm gear 25 to the driving shaft 21 via the worm gear 25. The shift tray 202 may be held at a reference position because the driving force is transmitted via the worm gear 25. The gear arrangement may prevent the shift tray 202 from dropping by accident.

The shield plate 24*a* may be integrally molded with the side plate 24. The full-load sensor 334 and the lower limit sensor 335 may be disposed under the shield plate 24*a*. The full-load sensor 334 may detect a full-load condition in which the shift tray 202 is fully loaded with sheets. The lower limit sensor 335 may detect a lower limit condition in which the shift tray 202 is positioned at a lower limit height. The full-load sensor 334 and the lower limit sensor 335 may include a photo sensor. When the shield plate 24*a* shields the full-load sensor 334 and/or the lower limit sensor 335, the full-load sensor 334 and/or the lower limit sensor 335 may be turned on.

Referring to FIG. 3, the following describes the shift mechanism J. The shift motor 169, serving as a driving source, may rotate the shift cam 31. The shift cam 31 may include an axis (not shown) on its center. At a position on a plane surface of the shift cam 31, that is, the position spaced from the axis of the shift cam 31 by a reference distance, one end of the pin 31*a* may be attached. The other end of the pin 31*a* may loosely engage with the hole 32*b* of the engaging member 32*a*. The engaging member 32*a* may be fixed to the back surface, which does not face the shift tray 202, of the end fence 32. When the shift motor 169 rotates the shift cam 31, the pin 31*a* may move the engaging member 32*a* back and forth in the direction perpendicular to the sheet conveyance direction. Accordingly, the shift tray 202 may move back and forth in the direction perpendicular to the sheet conveyance direction. The shift tray 202 may stop at two positions along the direction perpendicular to the sheet conveyance direction. The enlarged views of the engaging member 32*a* in FIG. 3 illustrate the engaging member 32*a* positioning the shift tray 202 at the two positions. One of the two positions may be near the front of the sheet processing apparatus 901. The other may be near the rear of the sheet processing apparatus 901. The shift tray sensor 336 may detect a notch (not shown) formed on the shift cam 31 to stop the shift tray 202 and output a detection signal. The shift motor 169 may be turned on and off in accordance with the detection signal.

The guide 32*c* may be disposed on the front surface, which faces the shift tray 202, of the end fence 32 and guides the shift tray 202. An edge of the shift tray 202 may loosely engage with the guide 32*c* in a manner that the edge moves upward and downward along the guide 32*c*. Thus, the end fence 32 may support the shift tray 202 in a manner that the shift tray 202 moves upward and downward along the front surface of the end fence 32 and moves back and forth in the direction perpendicular to the sheet conveyance direction along the front surface of the end fence 32. The end fence 32 may guide the tail edge of a sheet output onto the shift tray 202 and align the sheet in the sheet conveyance direction.

Figure 4:
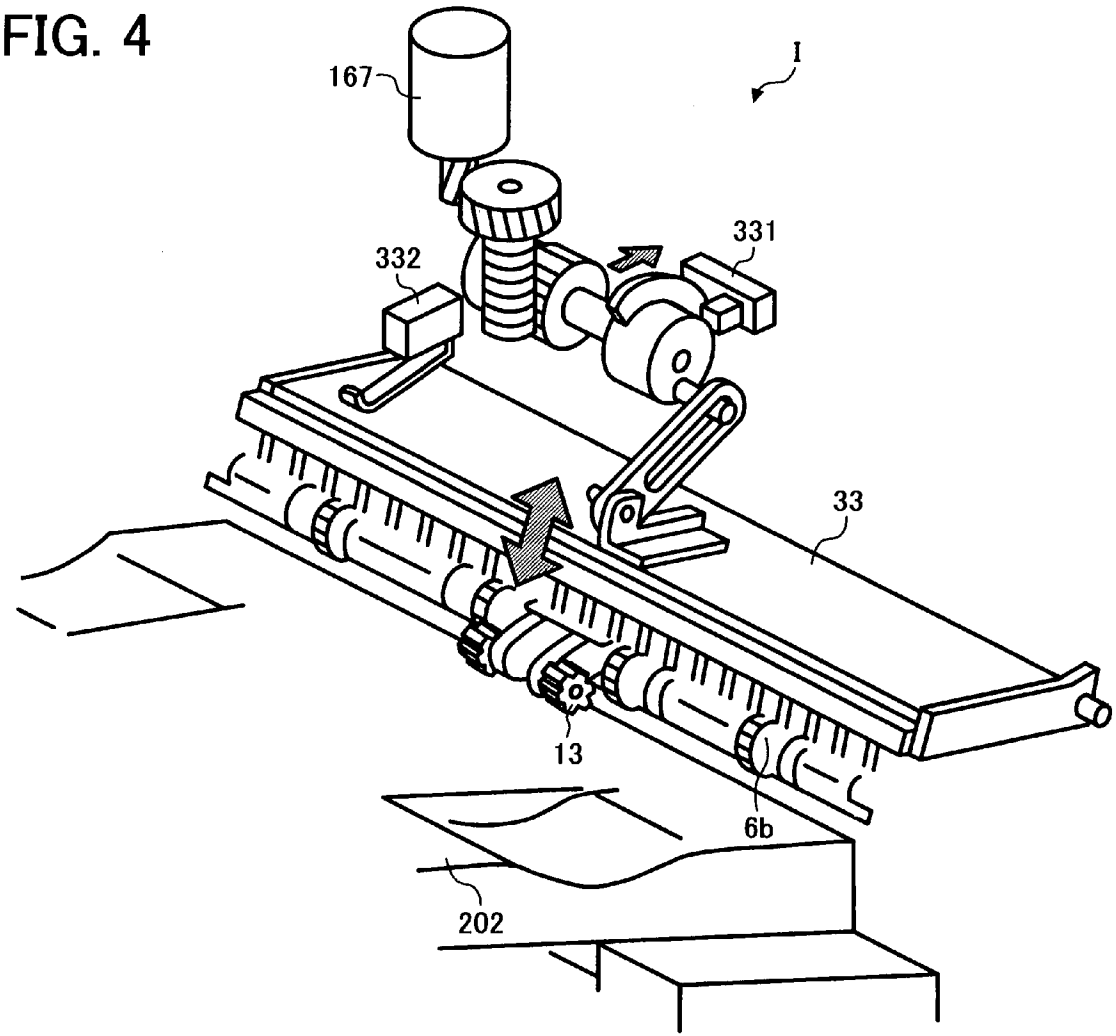
FIG. 4 is a perspective view (according to an example embodiment of the present invention) of a shift tray output section of the sheet processing apparatus shown in FIG. 1.

Referring to FIG. 4, the following describes a mechanism for feeding a sheet onto the shift tray 202. As illustrated in FIG. 4, the shift tray output section I may further include a guide plate 33, a guide plate sensor 331, a guide plate motor 167, and/or a guide plate limit switch 332.

The guide plate 33 may be supported at its upstream end in the sheet conveyance direction and may be movable upward and downward. Another free end of the guide plate 33 may rotatably support the driven roller 6*b*. The guide plate 33 may move upward to output sheets, and move back downward at a reference time determined based on a detection signal output by the shift tray output sensor 303 (depicted in FIG. 1). The guide plate sensor 331 may output a detection signal determining a stop position of the guide plate 33. The guide plate motor 167 may drive the guide plate 33. The guide plate limit switch 332 may be turned on and off to control driving of the guide plate motor 167.

Figure 5:
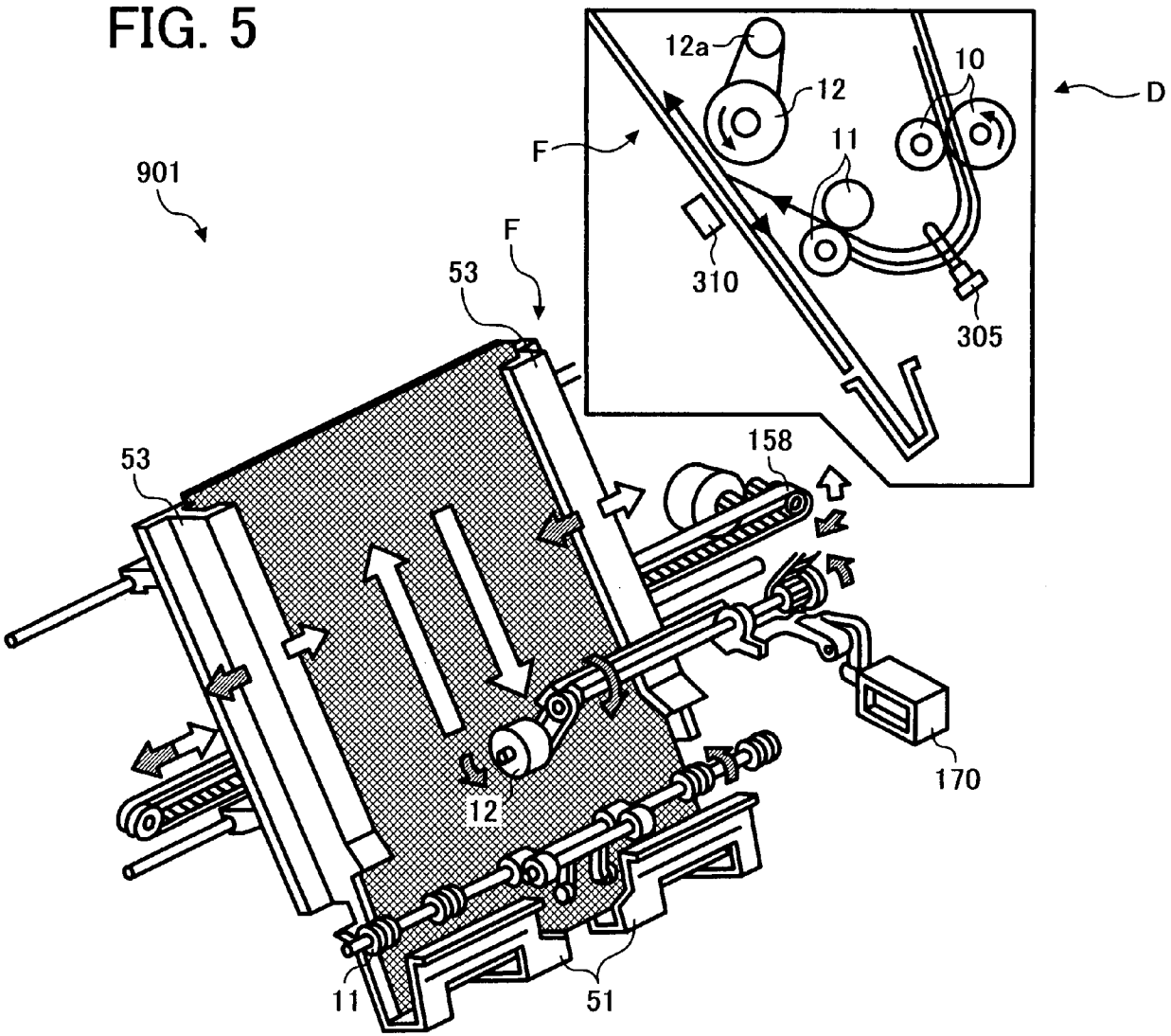
FIG. 5 is a perspective view (according to an example embodiment of the present invention) of a lower portion of an edge-stapling tray of the sheet processing apparatus shown in FIG. 1.
Figure 6:
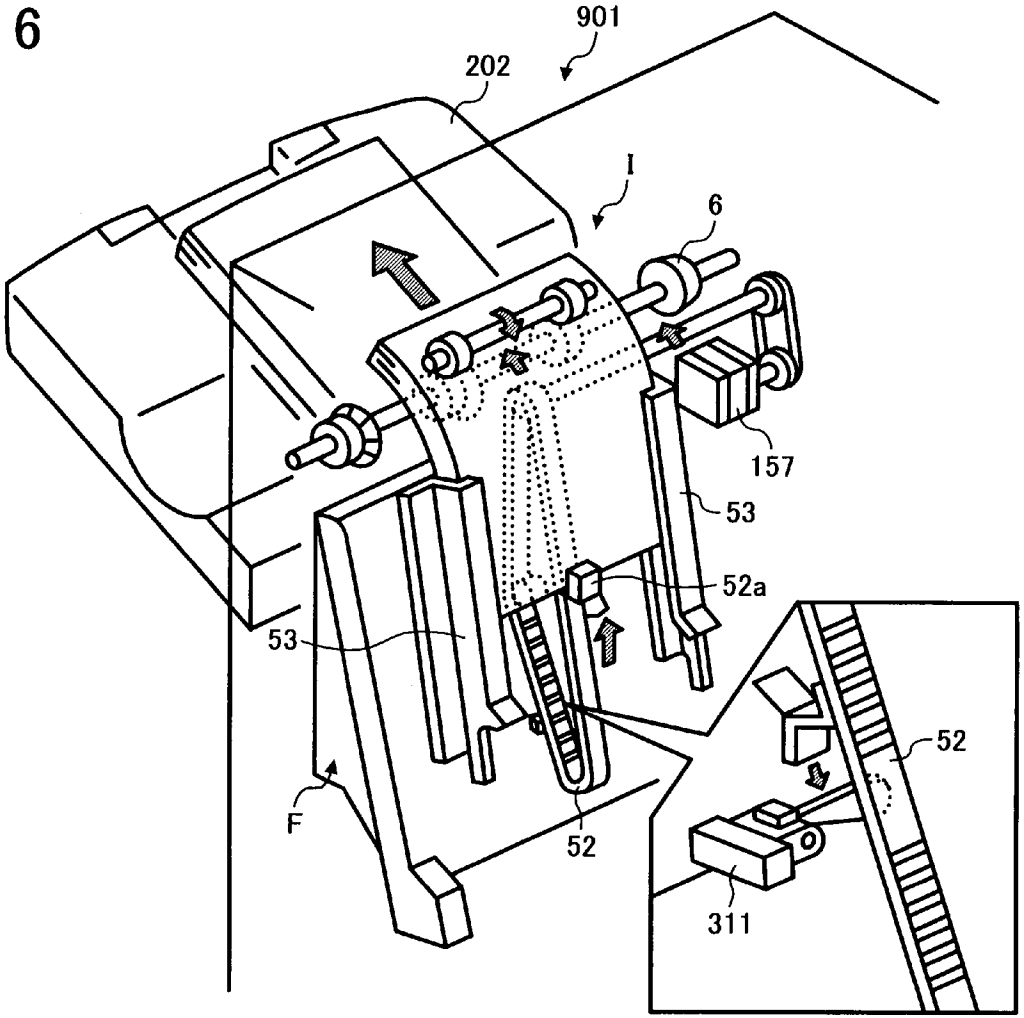
FIG. 6 is a perspective view (according to an example embodiment of the present invention) of an upper portion of an edge-stapling tray of the sheet processing apparatus shown in FIG. 1.
Figure 7:
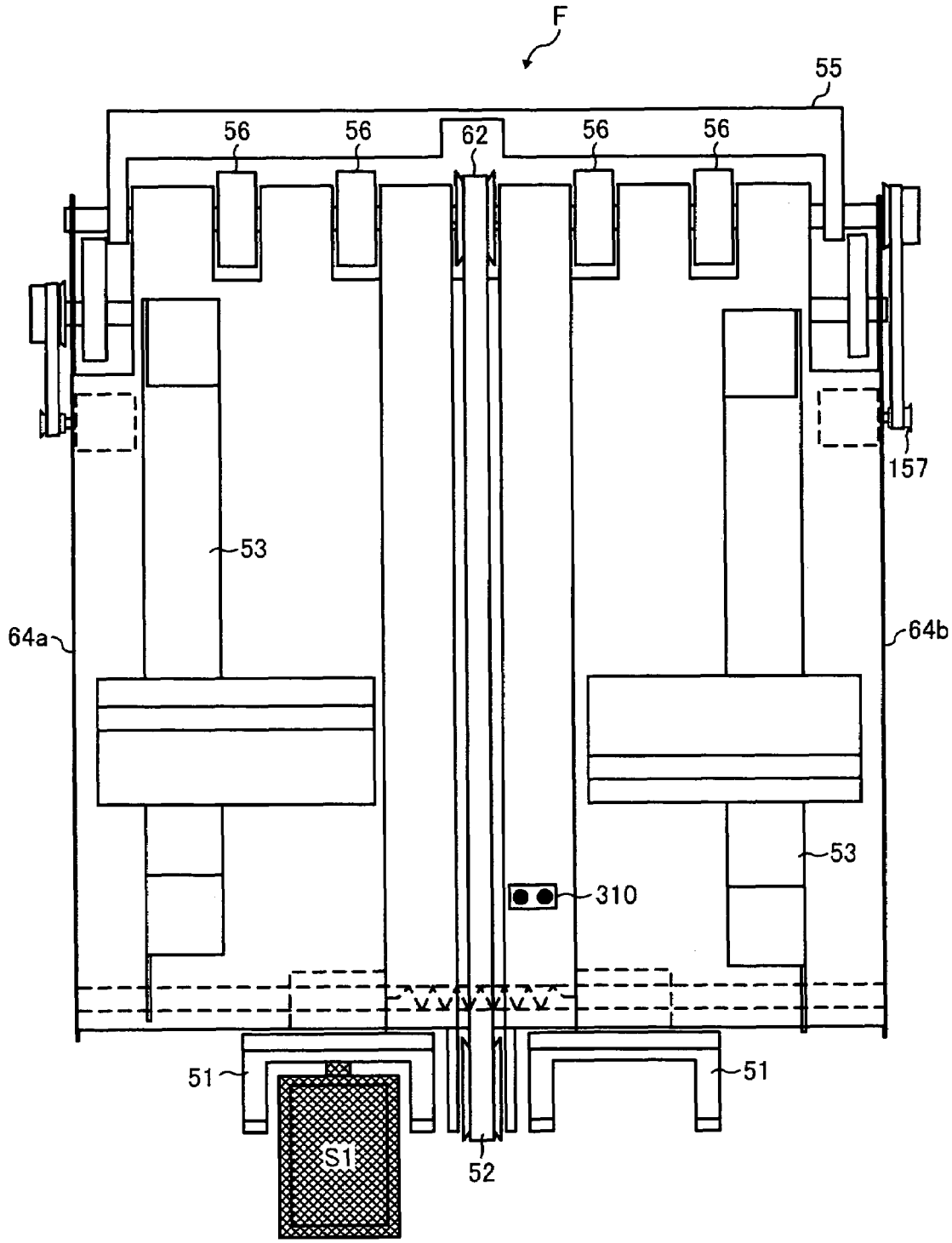
FIG. 7 is a side view (according to an example embodiment of the present invention) of an edge-stapling tray of the sheet processing apparatus shown in FIG. 1.

Referring to FIGS. 5 to 7, the following describes the edge-stapling tray F. As illustrated in FIG. 5, the edge-stapling tray F may further include an axis 12*a*, a solenoid 170, and/or a jogger motor 158. As illustrated in FIG. 6, the edge-stapling tray F may further include a discharging hook 52*a*, a discharging belt 52, a discharging motor 157, and/or a discharging belt sensor 311. As illustrated in FIG. 7, the edge-stapling tray F may further include a driving pulley 62, four discharging rollers 56, a front side plate 64*a*, and/or a back side plate 64*b*.

As illustrated in FIG. 5, the output roller pair 11 of the conveying path D may feed sheets toward the edge-stapling tray F. The sheets may be sequentially stacked in the edge-stapling tray F. Each sheet may be aligned by the roller 12 in the sheet conveyance direction and may be aligned by the jogger fences 53 in the direction perpendicular to the sheet conveyance direction. The stapler S1 (depicted in FIG. 7) may be driven based on a staple signal output by the controller 350 (depicted in FIG. 1) during an interval after the last sheet of a sheet stack is stacked in the edge-stapling tray F and before the first sheet of the next sheet stack is stacked in the edge-stapling tray F. Thus, the stapler S1 may staple sheets.

Referring to FIG. 5, the following describes a mechanism for stapling sheets. The solenoid 170 may cause the roller 12 to swing like a pendulum around the axis 12*a*. The roller 12 may rotate counterclockwise and intermittently contact a sheet to cause the sheet to contact the tail edge fence 51. The jogger motor 158, which is rotatable back and forth, may drive the jogger fences 53 via a timing belt (not shown) to move the jogger fences 53 back and forth in the direction perpendicular to the sheet conveyance direction.

As illustrated in FIG. 6, the discharging hook 52*a* may protrude from the discharging belt 52. The discharging belt 52 may convey the stapled sheet stack toward the shift tray output roller pair 6. The shift tray output roller pair 6 may feed the stapled sheet stack onto the shift tray 202. The discharging motor 157 may drive the discharging belt 52.

Referring to FIG. 6, the following describes a mechanism for discharging sheets. The discharging belt sensor 311 may detect the home position of the discharging hook 52*a*. The discharging hook 52*a*, which may be disposed on the discharging belt 52, may turn the discharging belt sensor 311 on and off. Two discharging hooks 52*a* may be positioned on an outer circumferential surface of the discharging belt 52 at locations spaced from each other in a circumferential direction of the discharging belt 52 in a manner that the two discharging hooks 52*a* oppose each other. The two discharging hooks 52*a* may alternately convey the stapled sheet stacks in the edge-stapling tray F one after another. The discharging belt 52 may be counter-rotated as needed. In example embodiments, the back of each of the discharging hooks 52*a* may contact and align the foremost edges of sheets placed in the edge-stapling tray F in the sheet conveyance direction. Thus, the discharging hooks 52*a* may also function as an aligner for aligning sheets in the sheet conveyance direction.

As illustrated in FIG. 7, the discharging motor 157 may drive the discharging belt 52. The discharging belt 52 and the driving pulley 62 may be disposed on the center of a shaft (not shown) of the discharging belt 52 in a longitudinal direction of the shaft. The four discharging rollers 56 may be disposed in parallel to each other. For example, two discharging rollers 56 and the other two discharging rollers 56 may be disposed symmetrically with respect to the driving pulley 62. The circumferential speed of the discharging rollers 56 may be faster than the circumferential speed of the discharging belt 52.

The sheet sensor 310 may detect whether or not a sheet is placed in the edge-stapling tray F.

Figure 8:
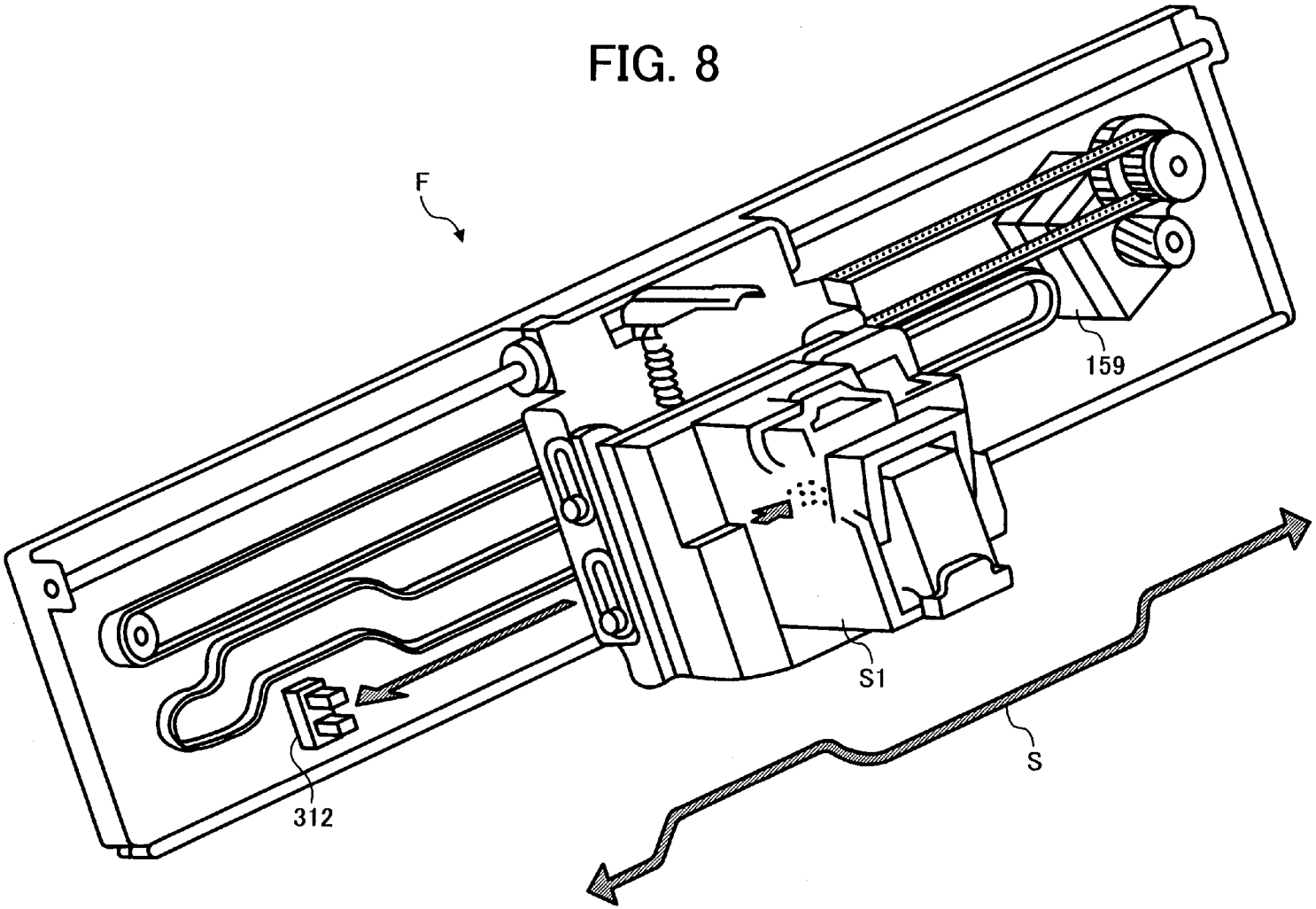
FIG. 8 is a perspective view (according to an example embodiment of the present invention) of a stapler of the edge-stapling tray shown in FIG. 7.

As illustrated in FIG. 8, the edge-stapling tray F may further include a stapler motor 159 and/or a stapler sensor 312. The stapler motor 159, which is rotatable back and forth, may drive the stapler S1 via a timing belt (not shown). The stapler S1 may move in the direction perpendicular to the sheet conveyance direction (e.g., directions S) to staple sheets at a reference edge position. The stapler sensor 312 may be disposed near one end of the movable area of the stapler S1 in the direction perpendicular to the sheet conveyance direction. The stapler sensor 312 may detect the home position of the stapler S1. The staple position in the direction perpendicular to the sheet conveyance direction may be adjusted based on the distance for which the stapler S1 moves from the home position.

Figure 9:
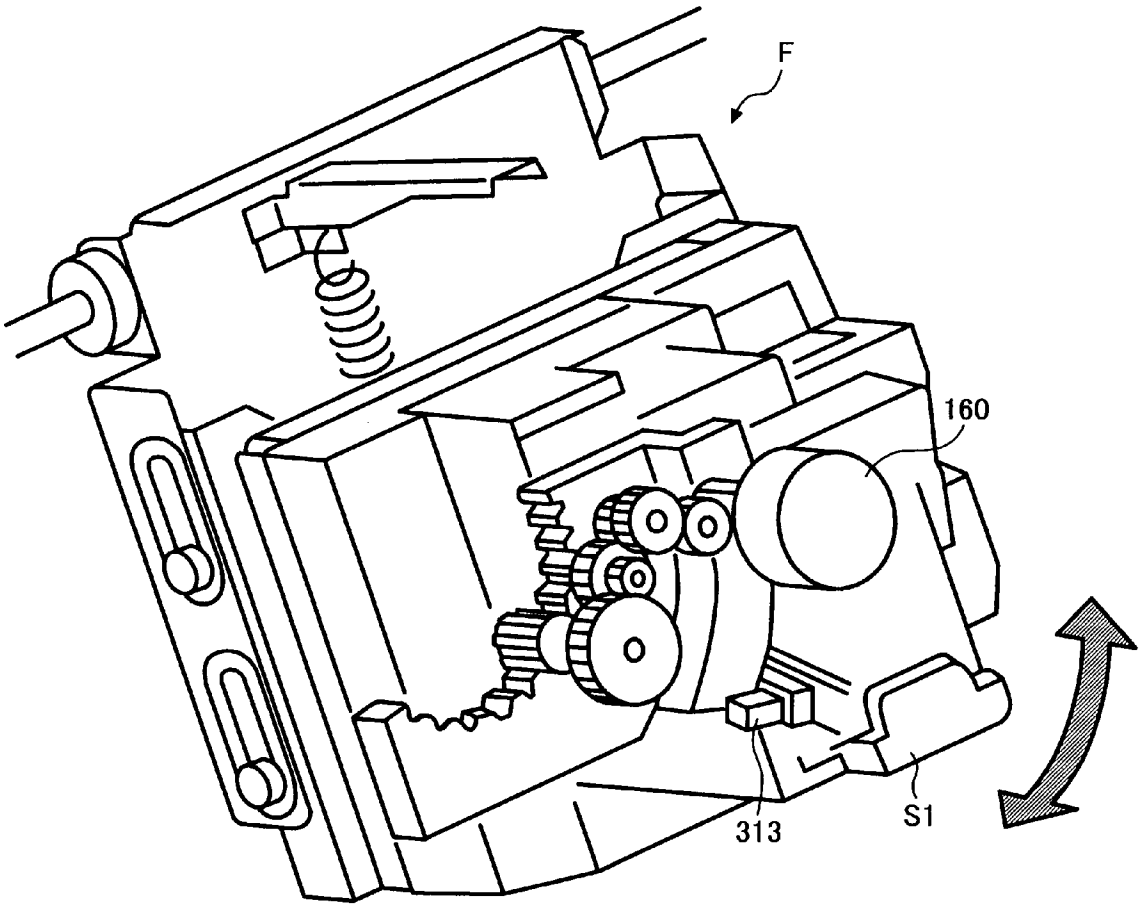
FIG. 9 is an enlarged view (according to an example embodiment of the present invention) of the stapler shown in FIG. 8.

As illustrated in FIG. 9, the edge-stapling tray F may further include an oblique motor 160 and/or a stapler sensor 313. The oblique motor 160 may rotate the stapler S1 by a reference angle. The stapler sensor 313 may detect the position of the stapler S1. The stapler S1 may drive a staple in parallel or obliquely relative to an edge of a sheet stack. When the oblique motor 160 rotates the stapler S1 by a reference angle to an oblique position, the stapler S1 may drive a staple obliquely relative to the edge of the sheet stack. Further, while the stapler S1 is at a home position, the stapler S1 may rotate only its staple mechanism (not shown) by a reference angle to a replenishing position at which a user can replenish staples. When the stapler sensor 313 detects that the stapler S is at the oblique position or the replenishing position, the oblique motor 160 may stop rotating. When the stapler S1 finishes stapling obliquely or when the user finishes replenishing staples, the stapler S1 may rotate back to the original position (i.e., the standby position) thereof to become ready for the next stapling operation.

Figure 10:
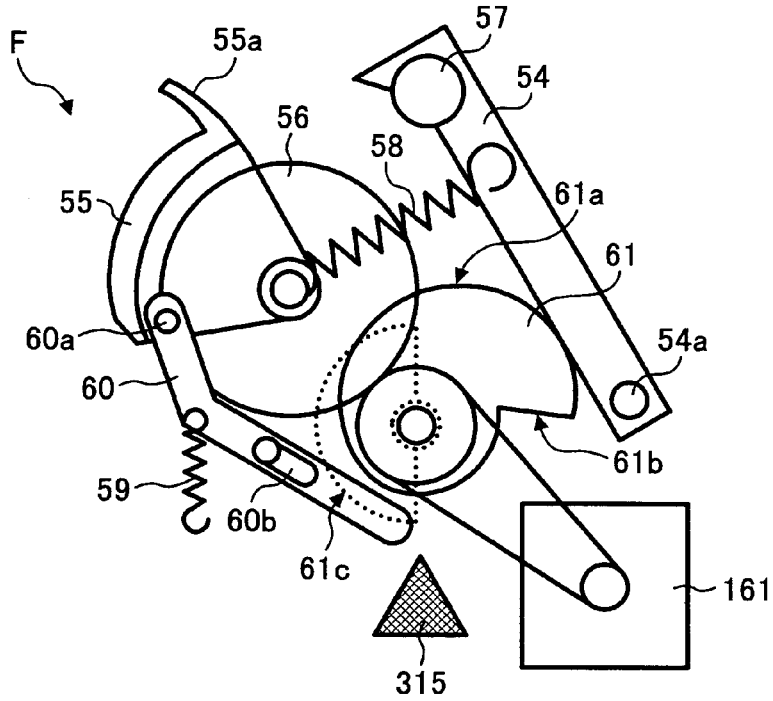
FIG. 10 is a sectional view (according to an example embodiment of the present invention) of a sheet stack guiding mechanism of an edge-stapling tray of the sheet processing apparatus shown in FIG. 1.
Figure 11:
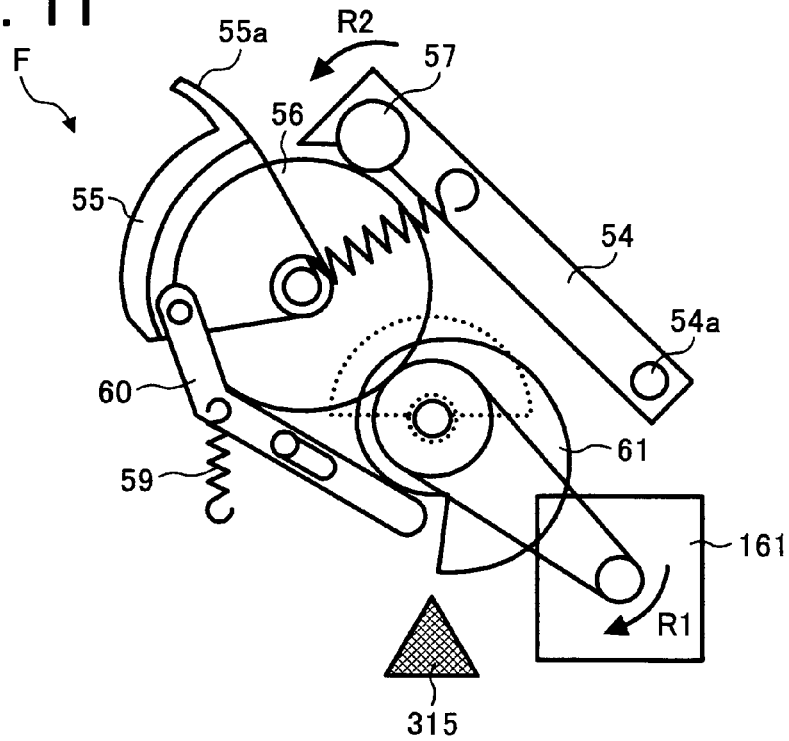
FIG. 11 is another sectional view (according to an example embodiment of the present invention) of a sheet stack guiding mechanism of an edge-stapling tray of the sheet processing apparatus shown in FIG. 1.
Figure 12:
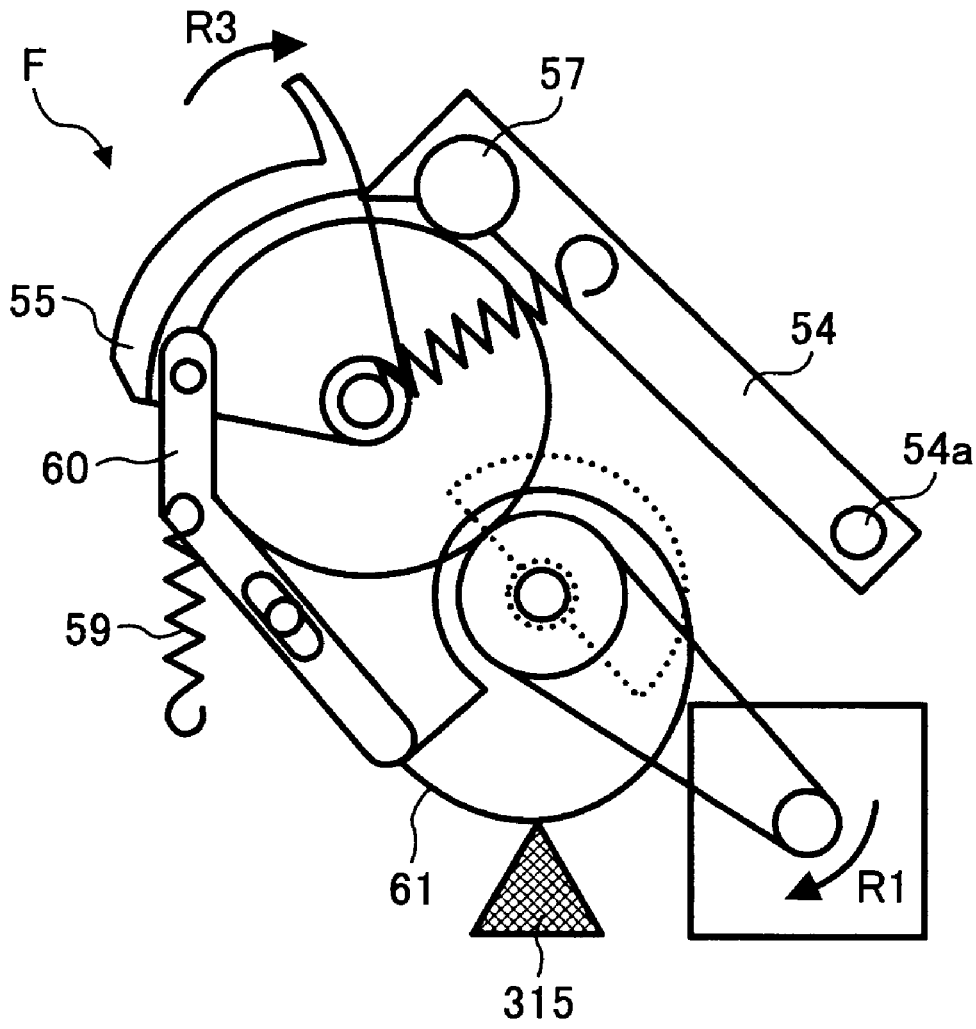
FIG. 12 is yet another sectional view (according to an example embodiment of the present invention) of a sheet stack guiding mechanism of an edge-stapling tray of the sheet processing apparatus shown in FIG. 1.

Referring to FIGS. 10 to 12, the following describes a sheet stack guiding mechanism. As illustrated in FIGS. 10 to 12, the edge-stapling tray F may further include an axis 54*a*, a pressing roller 57, a spring 58, a branch motor 161, a cam 61, a link arm 60, a linkage 60*a*, a spring 59, and/or a branch guide sensor 315. The cam 61 may include cam surfaces 61*a* and 61*b* and/or a shield portion 61*c*. The link arm 60 may include an elongated hole 60*b*. The movable guide 55 may include a guide surface 55*a*.

The axis 54*a* may swingably support the branch guide 54. The branch guide 54 may swing around the axis 54*a*. The pressing roller 57 may be rotatably disposed downstream from the axis 54*a* relative to the sheet conveyance direction. The spring 58 may apply a force to the pressing roller 57 to move the pressing roller 57 toward the discharging roller 56. The branch motor 161 may drive the cam 61. The cam surface 61*a* of the cam 61 may regulate the position of the branch guide 54 contacting the cam surface 61*a*.

The discharging roller 56 may include a rotating shaft (not shown) swingably supporting the movable guide 55. The link arm 60 may be disposed on one end of the movable guide 55, which may be opposite to another end disposed closer to the branch guide 54, in a rotating direction of the discharging roller 56. The linkage 60*a* may rotatably link the link arm 60 to the movable guide 55. A shaft (not shown) fixed to the front side plate 64*a* (depicted in FIG. 7) may move in the elongated hole 60*b* to limit the swingable range of the movable guide 55. The spring 59 may be connected to the link arm 60. The spring 59 may apply a force for moving the link arm 60 downward to keep the position of the link arm 60 as illustrated in FIG. 10. When the branch motor 161 rotates, the cam 61 and thereby the cam surface 61*b* of the rotating cam 61 pushes the link arm 60, the movable guide 55 connected to the link arm 60 rotates upward. The branch guide sensor 315 may detect the shield portion 61*c* to identify the home position of the cam 61. The stop position of the cam 61 may be controlled based on the number of pulses of the branch motor 161 counted after the branch guide sensor 315 detects the home position of the cam 61. The guide surface 55*a* may guide a sheet stack guided by the branch guide 54 toward the shift tray output roller pair 6.

When the cam 61 is at the home position, the branch guide 54 and the movable guide 55 may be positioned as illustrated in FIG. 10. As illustrated in FIG. 11, when the cam 61 rotates in a rotating direction R1, the branch guide 54 may rotate counterclockwise (e.g., in a rotating direction R2) around the axis 54*a*. Thus, the pressing roller 57 may pressingly contact the discharging roller 56.

As illustrated in FIG. 12, when the cam 61 further rotates in the rotating direction R1, the movable guide 55 may rotate clockwise (e.g., in a rotating direction R3). Thus, the branch guide 54 and the movable guide 55 may be positioned to guide a sheet stack from the edge-stapling tray F toward the center-stapling tray G According to example embodiments, a single driving motor (e.g., the branch motor 161) may drive the branch guide 54 and the movable guide 55. However, different driving motors may separately drive the branch guide 54 and the movable guide 55 so that the branch guide 54 and the movable guide 55 may start moving and stop moving in accordance with the sheet size and the number of stapled sheets.

The center-stapling tray G (depicted in FIG. 1) disposed downstream from the edge-stapling tray F relative to the sheet conveyance direction may perform stapling and folding operations for binding a sheet stack into a magazine. The sheet stack guiding mechanism illustrated in FIGS. 10 to 12 may guide a sheet stack from the edge-stapling tray F toward the center-stapling tray G.

Figure 13:
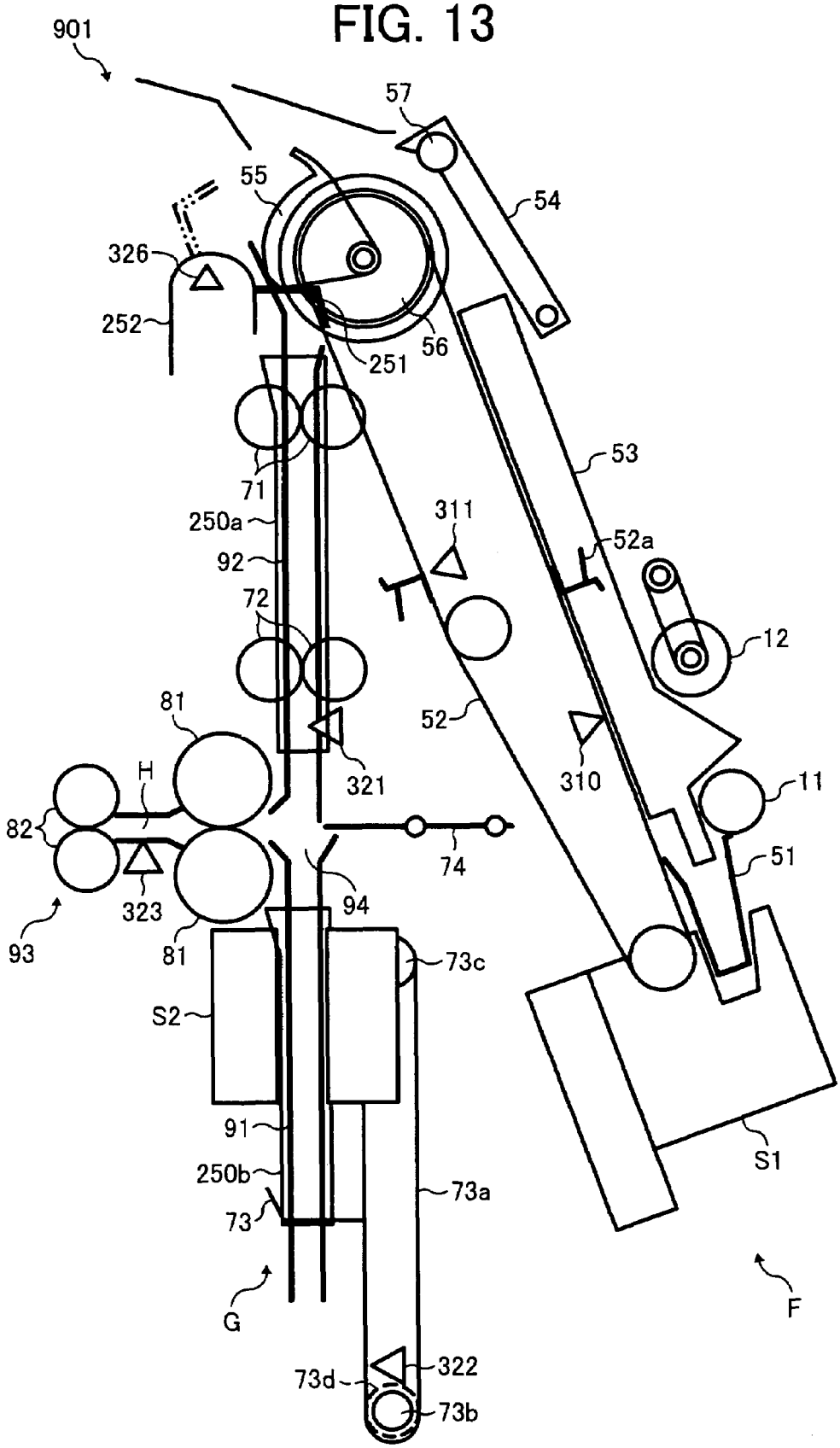
FIG. 13 is a sectional view (according to an example embodiment of the present invention) of an edge-stapling tray and a center-stapling tray of the sheet processing apparatus shown in FIG. 1.

Referring to FIG. 13, the following describes the center-stapling tray G. As illustrated in FIG. 13, the center-stapling tray G may be disposed on a downstream side from the sheet stack guiding mechanism relative to the sheet conveyance direction. The center-stapling tray G may extend substantially in the vertical direction. For example, the center-stapling tray G may be disposed at an angle at which the weight of a sheet stack conveys the sheet stack downward in the center-stapling tray G.

The fold mechanism 93 may be disposed in a center portion of the center-stapling tray G in the vertical direction. The upper guide 92 may be disposed above the fold mechanism 93. The lower guide 91 may be disposed under the fold mechanism 93. The upper guide 92 and the lower guide 91 may guide a sheet stack. The sheet conveyance path 94 may be formed along the upper guide 92 and the lower guide 91. The upper roller pair 71 may be disposed in an upper portion of the upper guide 92 in the vertical direction. The lower roller pair 72 may be disposed in a lower portion of the upper guide 92 in the vertical direction. The upper jogger fences 250*a* may be disposed along both sides of the upper guide 92 in a manner that the upper jogger fences 250*a* sandwich the upper roller pair 71 and the lower roller pair 72. Similarly, the lower jogger fences 250*b* may be disposed along both sides of the lower guide 91. The stapler S2 may be disposed in parallel to the lower jogger fences 250*b*. A driver (not shown) may drive the upper jogger fences 250*a* and the lower jogger fences 250*b*. The upper jogger fences 250*a* and the lower jogger fences 250*b* may align sheets forming a sheet stack in the direction perpendicular to the sheet conveyance direction. The stapler S2 may include two pairs of a clincher (not shown) and a driver (not shown). The two pairs of the clincher and the driver may be spaced from each other in a manner that a reference distance is provided between the two pairs of the clincher and the driver in the direction perpendicular to the sheet conveyance direction. However, the stapler S2 may include one pair of the clincher and the driver. In example embodiments, the one pair of the clincher and the driver may move in the direction perpendicular to the sheet conveyance direction to staple sheets at two positions.

The edge fence 73 may be disposed to cross the lower guide 91. A moving mechanism (not shown) may move the edge fence 73 in the sheet conveyance direction (e.g., up and down in FIG. 13). The moving mechanism may include the timing belt 73*a* and/or a driving mechanism (not shown) for driving the timing belt 73*a*. The driving mechanism may include the driving pulley 73*b*, the driven pulley 73*c*, and/or the stepping motor 73*d*. The stepping motor 73*d* may drive the driving pulley 73*b*. The timing belt 73*a* may be looped over the driving pulley 73*b* and the driven pulley 73*c*. The driving pulley 73*b* may rotate the timing belt 73*a*. The rotating timing belt 73*a* rotates the driven pulley 73*c*. The tapper 251 and a driving mechanism (not shown) for driving the tapper 251 may be disposed above the upper guide 92. The driving mechanism and the timing belt 252 may move the tapper 251 back and forth both in a direction to move the tapper 251 away from the sheet stack guiding mechanism illustrated in FIGS. 10 to 12 and in a direction to push the tail edge of a sheet stack in the sheet conveyance direction for conveying the sheet stack from the edge-stapling tray F to the center-stapling tray G. The tapper sensor 326 may detect the home position of the tapper 251.

The fold plate 74 may push the substantially center line of a stapled sheet stack in the sheet conveyance direction into a nip formed by the fold roller pair 81. The fold roller pairs 81 and 82 may nip the stapled sheet stack to fold the stapled sheet stack along the substantially center line of the stapled sheet stack in the sheet conveyance direction.

Figure 14:
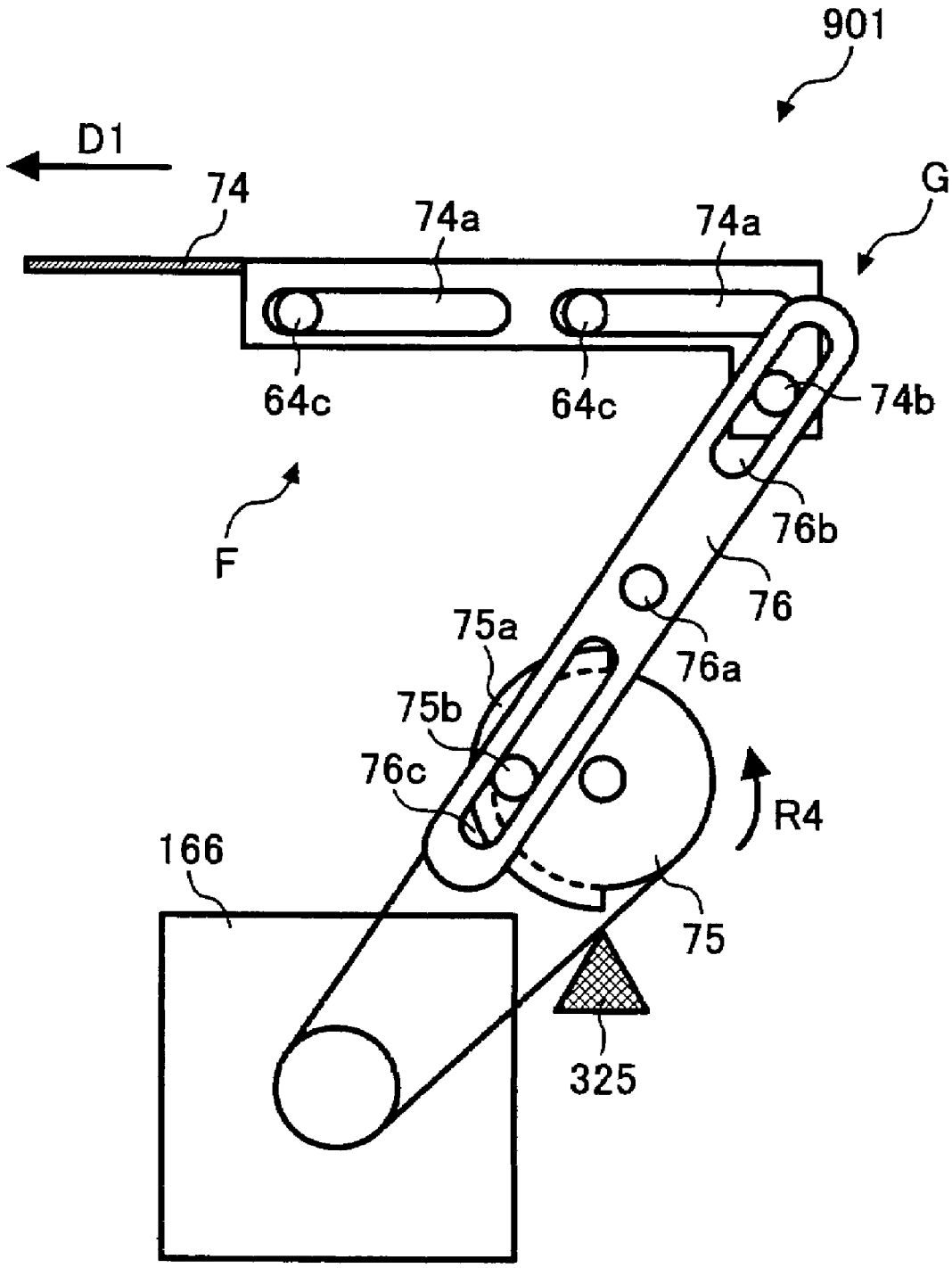
FIG. 14 is a sectional view (according to an example embodiment of the present invention) of a fold plate moving mechanism of the center-stapling tray shown in FIG. 13.
Figure 15:
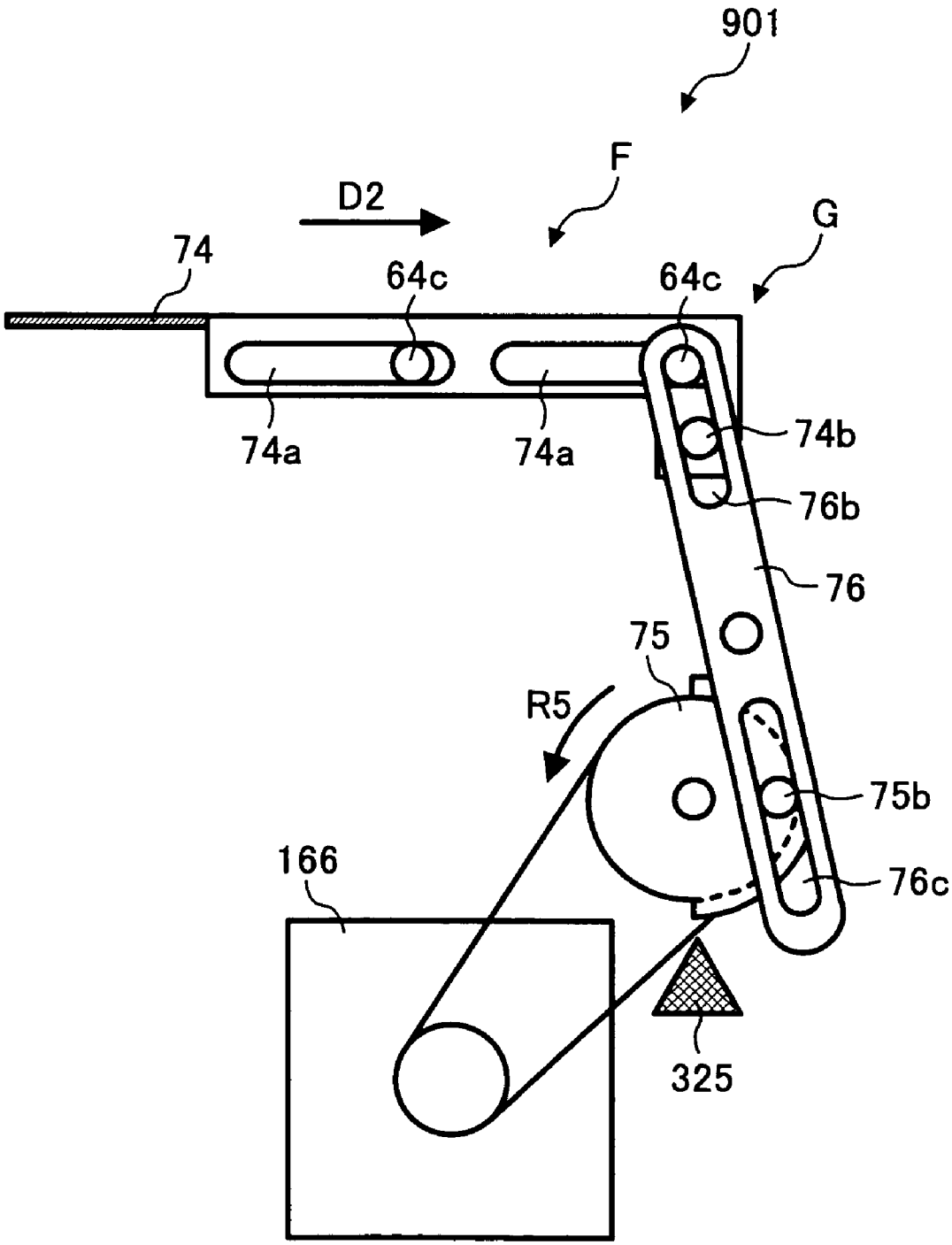
FIG. 15 is another sectional view (according to an example embodiment of the present invention) of a fold plate moving mechanism of the center-stapling tray shown in FIG. 13.

Referring to FIGS. 14 and 15, the following describes a fold plate moving mechanism for moving the fold plate 74 to fold a stapled sheet stack along the substantially center line of the stapled sheet stack in the sheet conveyance direction. As illustrated in FIGS. 14 and 15, the edge-stapling tray F may further include shafts 64*c*. The center-stapling tray G may further include a link arm 76, a fold plate cam 75, a fold plate motor 166, and/or a fold plate sensor 325. The fold plate 74 may include elongated holes 74*a* and/or a shaft 74*b*. The link arm 76 may include an axis 76*a* and/or elongated holes 76*b* and 76*c*. The fold plate cam 75 may include a shaft 75*b* and/or a shield portion 75*a*.

The two shafts 64*c* may be mounted on each of the front side plate 64*a* (depicted in FIG. 7) and the back side plate 64*b* (depicted in FIG. 7). The shafts 64*c* may loosely engage with the elongated holes 74*a* to support the fold plate 74. The shaft 74*b* may be mounted on the fold plate 74 and loosely engage with the elongated hole 76*b*. The link arm 76 may swing around the axis 76*a*. Thus, the fold plate 74 may move in a direction D1 (depicted in FIG. 14) and a direction D2 (depicted in FIG. 15). The shaft 75*b* of the fold plate cam 75 may loosely engage with the elongated hole 76*c*. The fold plate motor 166 may rotate the fold plate cam 75 in a rotating direction R4 (depicted in FIG. 14). Thus, the link arm 76 may swing in accordance with rotation of the fold plate cam 75. As a result, the fold plate 74 may move back and forth in a direction perpendicular to the longitudinal direction of the lower guide 91 and the upper guide 92 (depicted in FIG. 13). The shield portion 75*a* may have a half-moon shape. The fold plate sensor 325 may detect both ends of the shield portion 75*a* in the rotating direction R4 to determine the stop position of the fold plate cam 75.

FIG. 14 illustrates the home position of the fold plate 74 where the fold plate 74 is completely retreated from the sheet conveyance path 94 (depicted in FIG. 13). When the fold plate cam 75 rotates in the rotating direction R4, the fold plate 74 may move in the direction D1 and enters the sheet conveyance path 94.

FIG. 15 illustrates the position of the fold plate 74 when the fold plate 74 pushes the substantially center line of a stapled sheet stack in the sheet conveyance direction into the nip formed by the fold roller pair 81 (depicted in FIG. 13). When the fold plate cam 75 rotates in a rotating direction R5, the fold plate 74 may move in the direction D2 and is retreated from the sheet conveyance path 94 (depicted in FIG. 13).

According to example embodiments, sheets forming a sheet stack may be folded along the substantially center line of the sheets in the sheet conveyance direction after the sheets are stapled. However, a single sheet may be folded according to example embodiments. In example embodiments, the sheet needs not be stapled. For example, when a sheet is conveyed from the image forming apparatus 900 (depicted in FIG. 1) into the sheet processing apparatus 901, the sheet may be conveyed to the center-stapling tray G without being stapled. The fold plate 74 and the fold roller pairs 81 and 82 (depicted in FIG. 13) may fold the sheet, and the fold roller pair 82 may feed the sheet onto the lower tray 203 (depicted in FIG. 1).

Figures 16, 16A:
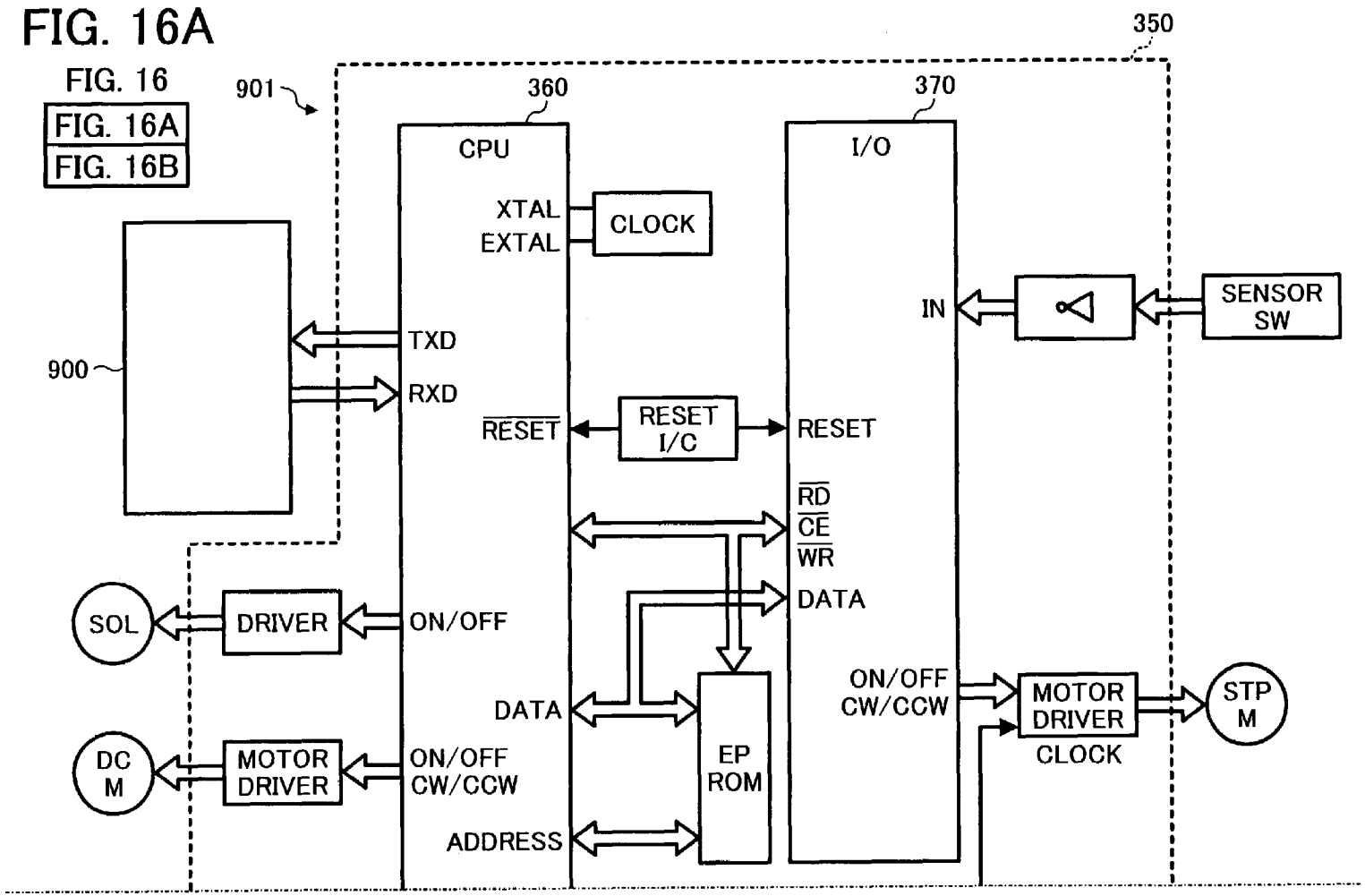
FIGS. 16A and 16B illustrate a block diagram (according to an example embodiment of the present invention) of a controller of the sheet processing apparatus shown in FIG. 1.
Figure 16B:
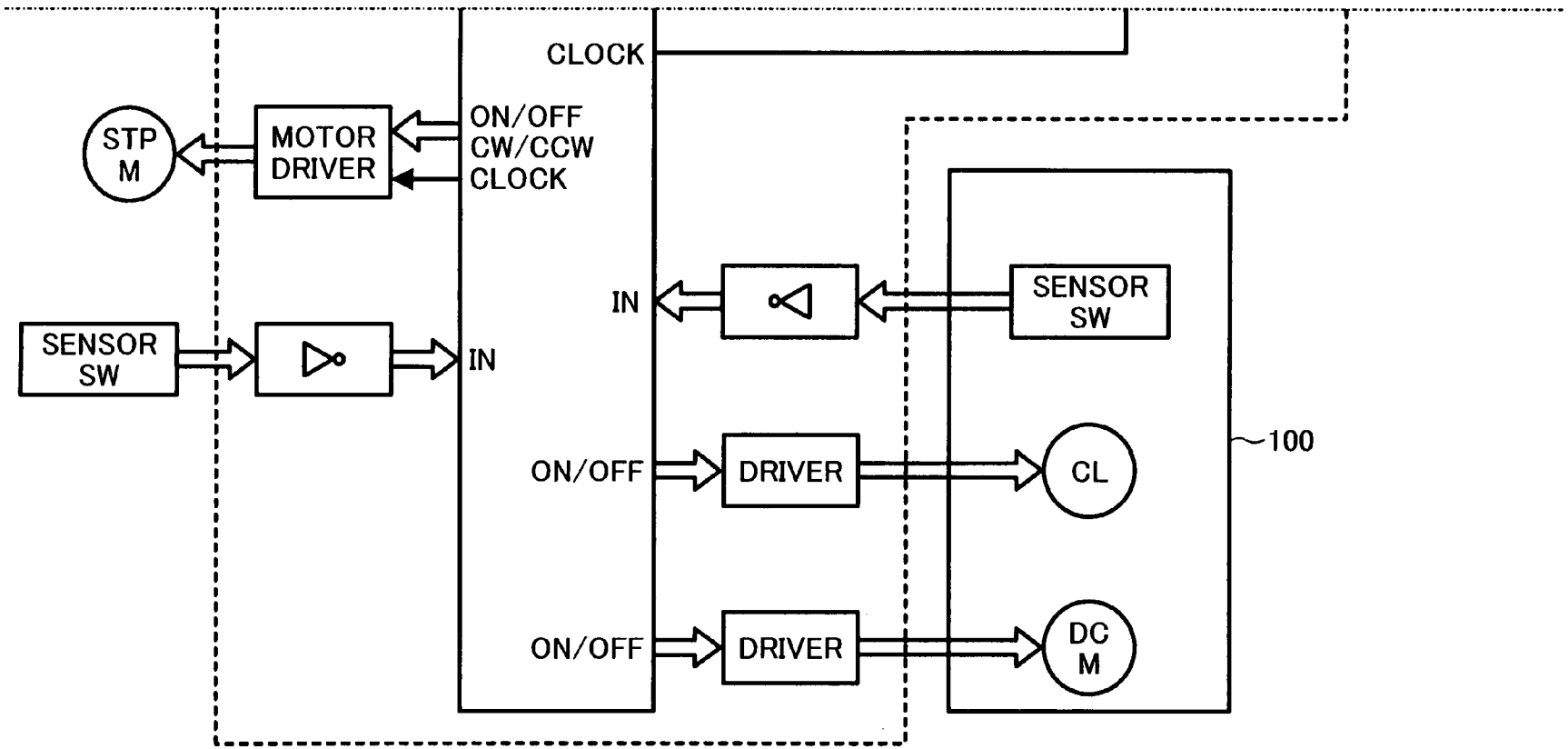

Referring to FIGS. 16A and 16B, the following describes the controller 350. As illustrated in FIGS. 16A and 16B, the controller 350 may be a micro computer, for example, and may include a CPU (central processing unit) 360 and/or an I/O (input-output) interface 370. The CPU 360 may receive a signal output by switches of a control panel (not shown) of the image forming apparatus 900. The CPU 360 may also receive via the I/O interface 370 a signal output by the sensors of the sheet processing apparatus 901. The sensors of the sheet processing apparatus 901 may include the entrance sensor 301 (depicted in FIG. 1), the upper tray output sensor 302 (depicted in FIG. 1), the shift tray output sensor 303 (depicted in FIG. 1), the pre-stack sensor 304 (depicted in FIG. 1), the stapler output sensor 305 (depicted in FIG. 1), the sheet sensor 310 (depicted in FIG. 1), the discharging belt sensor 311 (depicted in FIG. 6), the stapler sensor 312 (depicted in FIG. 8), the stapler sensor 313 (depicted in FIG. 9), the branch guide sensor 315 (depicted in FIG. 10), the sheet sensors 321, 322, and 323 (depicted in FIG. 1), the sheet sensor 330 (depicted in FIG. 1), the stapled sheet sensor 330*a* (depicted in FIG. 2), the non-stapled sheet sensor 330*b* (depicted in FIG. 2), the sheet sensor 505 (depicted in FIG. 1), and/or the guide plate sensor 331 (depicted in FIG. 4).

The CPU 360 may control driving of the motors based on the received signal. The motors may include the tray moving motor 168 (depicted in FIG. 2), the guide plate motor 167 (depicted in FIG. 4), the shift motor 169 (depicted in FIG. 3), a motor (not shown) for driving the roller 12 (depicted in FIG. 1), solenoids, for example, the solenoid 170 (depicted in FIG.

5), conveying roller motors (not shown) for driving conveying rollers (not shown), output roller motors (not shown) for driving output rollers (not shown), the discharging motor 157 (depicted in FIG. 6), the stapler motor 159 (depicted in FIG. 8), the oblique motor 160 (depicted in FIG. 9), the jogger motor 158 (depicted in FIG. 5), the branch motor 161 (depicted in FIG. 10), the stepping motor 73*d* (depicted in FIG. 1), the fold plate motor 166 (depicted in FIG. 14), and/or a motor (not shown) for driving the fold roller pair 81 (depicted in FIG. 13).

The CPU 360 may receive and count a pulse signal output by a motor (not shown) for driving the output roller pair 11 (depicted in FIG. 1). The CPU 360 may control driving of the solenoid 170 and the jogger motor 158 (depicted in FIG. 5) based on the count. The CPU 360 may also cause the punch unit 100 to punch a hole in a sheet by controlling a clutch (not shown) and a motor (not shown) for the punch unit 100. The CPU 360 may execute a program stored in a ROM (read-only memory) (not shown) by using a RAM (random-access memory) (not shown) as a work area.

The following describes operations of the sheet processing apparatus 901 carried out by the controller 350 according to example embodiments. The sheet processing apparatus 901 may provide various modes for outputting processed sheets, for example, a non-staple mode A, a non-staple mode B, a sort-stack mode, a staple mode, and a magazine mode.

The following describes the non-staple mode A. As illustrated in FIG. 1, in the non-staple mode A, sheets sent from the image forming apparatus 900 may be conveyed in the conveyance paths A and B and may be output onto the upper tray 201 without being stapled. The branch nail 15 may be held at the position illustrated in FIG. 1 to guide the sheets to the conveyance path B. For example, when the image forming apparatus 900 conveys sheets to the sheet processing apparatus 901, the entrance roller pair 1 and the conveying roller pair 2 of the conveyance path A and the conveying roller pair 3 and the upper tray output roller pair 4 of the conveyance path B may start rotating to feed the sheets one by one to the upper tray 201 in the sheet processing apparatus 901. The entrance sensor 301 may be turned on when the entrance sensor 301 detects a sheet sent from the image forming apparatus 900. The upper tray output sensor 302 may detect whether or not the sheet passes the upper tray output sensor 302. When a reference time period elapses after the upper tray output sensor 302 detects that the last sheet passes the upper tray output sensor 302, the controller 350 may stop rotating the entrance roller pair 1, the conveying roller pairs 2 and 3, and/or the upper tray output roller pair 4. Thus, the sheets sent from the image forming apparatus 900 may be output onto the upper tray 201 without being stapled. According to example embodiments, the punch unit 100 may be disposed between the entrance roller pair 1 and the conveying roller pair 2 in the sheet conveyance direction. Therefore, the punch unit 100 may punch a hole in a sheet when the entrance roller pair 1 and the conveying roller pair 2 convey the sheet.

The following describes the non-staple mode B. As illustrated in FIG. 1, in the non-staple mode B, sheets sent from the image forming apparatus 900 may be conveyed in the conveyance paths A and C and may be output onto the shift tray 202 without being stapled. The branch nail 15 may rotate counterclockwise and the branch nail 16 may rotate clockwise, to guide the sheets to the conveyance path C.

For example, when the image forming apparatus 900 conveys sheets to the sheet processing apparatus 901, the entrance roller pair 1 and the conveying roller pair 2 of the conveyance path A, the conveying roller pair 5 of the conveyance path C, and/or the shift tray output roller pair 6 of the shift tray output section I may start rotating to feed the sheets one by one to the shift tray 202 in the sheet processing apparatus 901. The solenoids for driving the branch nails 15 and 16 may be turned on to rotate the branch nail 15 counterclockwise and to rotate the branch nail 16 clockwise. The entrance sensor 301 may be turned on when the entrance sensor 301 detects a sheet sent from the image forming apparatus 900. The shift tray output sensor 303 may detect whether or not the sheet passes the shift tray output sensor 303. When a reference time period elapses after the shift tray output sensor 303 detects that the last sheet passes the shift tray output sensor 303, the controller 350 may stop rotating the entrance roller pair 1, the conveying roller pairs 2 and 5, and/or the shift tray output roller pair 6. The controller 350 may also turn off the solenoids for driving the branch nails 15 and 16. Thus, the sheets sent from the image forming apparatus 900 may be output onto the shift tray 202 without being stapled. According to example embodiments, the punch unit 100 may be disposed between the entrance roller pair 1 and the conveying roller pair 2 in the sheet conveyance direction. Therefore, the punch unit 100 may punch a hole in a sheet when the entrance roller pair 1 and the conveying roller pair 2 convey the sheet.

The following describes the sort-stack mode. As illustrated in FIG. 1, in the sort-stack mode, sheets sent from the image forming apparatus 900 may be conveyed in the conveyance paths A and C and may be output onto the shift tray 202 without being stapled. The shift tray 202 may move in the direction perpendicular to the sheet conveyance direction so that every other sheet stack is shifted when delivered onto the shift tray 202. The branch nail 15 may rotate counterclockwise and the branch nail 16 may rotate clockwise, to guide the sheets to the conveyance path C. For example, when the image forming apparatus 900 conveys sheets to the sheet processing apparatus 901, the entrance roller pair 1 and the conveying roller pair 2 of the conveyance path A, the conveying roller pair 5 of the conveyance path C, and/or the shift tray output roller pair 6 of the shift tray output section I may start rotating to feed the sheets one by one to the shift tray 202 in the sheet processing apparatus 901. The solenoids for driving the branch nails 15 and 16 may be turned on to rotate the branch nail 15 counterclockwise and to rotate the branch nail 16 clockwise. The entrance sensor 301 may be turned on when the entrance sensor 301 detects a sheet sent from the image forming apparatus 900. The shift tray output sensor 303 may detect whether or not the sheet passes the shift tray output sensor 303. When the shift tray output sensor 303 detects the first sheet of a sheet stack, the controller 350 may turn on the shift motor 169 (depicted in FIG. 3) to move the shift tray 202 in the direction perpendicular to the sheet conveyance direction until the shift tray sensor 336 (depicted in FIG. 3) detects the shift tray 202. Thus, the sheet tray 202 may be shifted and receive the sheet. When the shift tray output sensor 303 detects that a sheet passes the shift tray output sensor 303, the controller 350 may determine whether or not the sheet is the last sheet of a sheet stack. When the controller 350 determines that the sheet is not the last sheet (e.g., the sheet is the first sheet of another sheet stack), the controller 350 may move the shift tray 202 when the sheet stack includes two or more sheets. When the sheet stack includes a single sheet, the controller 350 may stop rotating the entrance roller pair 1, the conveying roller pairs 2 and 5, and the shift tray output roller pair 6. When the controller 350 determines that the sheet is not the first sheet of another sheet stack, the sheet may be output onto the shifted shift tray 202. The controller 350 may determine whether or not the output sheet is the last sheet of a sheet stack. When the controller 350 determines that the output sheet is not the last sheet, the next sheet may be output onto the shift tray 202. When the controller 350 determines that the output sheet is the last sheet, the controller 350 may stop rotating the entrance roller pair 1, the conveying roller pairs 2 and 5, and the shift tray output roller pair 6 when a reference time period elapses after the shift tray output sensor 303 detects that the sheet passes the shift tray output sensor 303. The controller 350 may also turn off the solenoids for driving the branch nails 15 and 16. Thus, the sheets sent from the image forming apparatus 900 may be output onto the shift tray 202 without being stapled in a manner that every other sheet stack is shifted on the shift tray 202. According to example embodiments, the punch unit 100 may punch a hole in a sheet when the entrance roller pair 1 and the conveying roller pair 2 convey the sheet.

The following describes the staple mode. As illustrated in FIG. 1, in the staple mode, sheets sent from the image forming apparatus 900 may be conveyed in the conveyance paths A and D, the edge-stapling tray F, and the conveyance path C and are output onto the shift tray 202. In the edge-stapling tray F, the sheets may be aligned and stapled. The branch nail 15 may rotate counterclockwise and the branch nail 16 may be held at the position illustrated in FIG. 1 to guide the sheets to the conveyance path D.

For example, when the image forming apparatus 900 conveys sheets to the sheet processing apparatus 901, the entrance roller pair 1 and the conveying roller pair 2 of the conveyance path A, the conveying roller pairs 7, 9, and 10 and the output roller pair 11 of the conveyance path D, and/or the roller 12 of the edge-stapling tray F may start rotating to feed the sheets one by one to the edge-stapling tray F in the sheet processing apparatus 901. The solenoid for driving the branch nail 15 may be turned on to rotate the branch nail 15 counterclockwise. The stapler sensor 312 (depicted in FIG. 8) may detect the home position of the stapler S1. The controller 350 may drive the stapler motor 159 (depicted in FIG. 8). The stapler motor 159 may move the stapler S1 to the staple position based on the detection result. The controller 350 may also move each of the discharging belt 52 (depicted in FIG. 6), the jogger fences 53, the branch guide 54, and/or the movable guide 55 to the home position thereof.

When the entrance sensor 301 is turned on and off, the stapler output sensor 305 is turned on, and the shift tray output sensor 303 is turned off, the controller 350 may determine that a sheet is in the edge-stapling tray F. The solenoid 170 (depicted in FIG. 5) may be turned on for a reference time period to cause the roller 12 to contact the sheet. The roller 12 may apply a force to the sheet to cause the tail edge of the sheet to contact the tail edge fence 51. Thus, the sheet may be aligned in the sheet conveyance direction. The controller 350 may drive the jogger motor 158 (depicted in FIG. 5) to move the jogger fences 53. The jogger fences 53 may move closer to each other for a reference distance to align the sheet in the direction perpendicular to the sheet conveyance direction. The jogger fences 53 may move back to the original positions (e.g., the standby positions) thereof. Thus, the sheet may be aligned both in the sheet conveyance direction and the direction perpendicular to the sheet conveyance direction. The above-described operation may be performed whenever a sheet is delivered to the edge-stapling tray F. When the last sheet of a sheet stack is aligned, the jogger fences 53 move closer to each other for a reference distance to prevent sheets forming the sheet stack from being shifted from each other. The controller 350 may turn on the stapler S1 to staple the sheets at a position on an edge portion of the sheets.

The shift tray 202 may be lowered by a reference length to provide a space to be occupied by sheets output onto the shift tray 202. The controller 350 may drive a motor (not shown) for driving the shift tray output roller pair 6 to rotate the shift tray output roller pair 6. The discharging motor 157 (depicted in FIG. 6) may be turned on to rotate the discharging belt 52 (depicted in FIG. 6) for a reference amount so that the discharging belt 52 pushes up the stapled sheet stack toward the shift tray output section I via the conveyance path C. In the shift tray output section I, the shift tray output roller pair 6 may nip and feed the stapled sheet stack onto the shift tray 202. When the shift tray output sensor 303 detects the stapled sheet stack, the shift tray output sensor 303 may output an ON signal. When the stapled sheet stack passes the shift tray output sensor 303, the shift tray output sensor 303 may output an OFF signal. When the controller 350 determines that the stapled sheet stack passes the shift tray output sensor 303 based on the ON and OFF signals (e.g., when the shift tray output roller pair 6 finishes feeding the stapled sheet stack onto the shift tray 202), the controller 350 may move each of the discharging belt 52 and the jogger fences 53 back to the original position (e.g., standby position) thereof. When a reference time period elapses, the controller 350 may stop rotating the shift tray output roller 6 and lift the shift tray 202 up to the original position thereof. The above-described operations may be repeated until a job is finished.

When the job is finished, the controller 350 may move each of the stapler S1, the discharging belt 52 (depicted in FIG. 6), and/or the jogger fences 53 back to the home position thereof. The controller 350 may stop rotating the entrance roller 1, the conveying roller pairs 2, 7, 9, and 10, the output roller pair 11, and/or the roller 12. The controller 350 may turn off the solenoid assigned to the branch nail 15. For example, the elements used for the job may be moved back to the original positions or conditions thereof. As described above, the sheets sent from the image forming apparatus 900 may be stapled in the edge-stapling tray F and may be output onto the shift tray 202. The punch unit 100 may punch a hole in a sheet when the entrance roller pair 1 and the conveying roller pair 2 may convey the sheet.

The following describes detailed operations of the edge-stapling tray F in the staple mode. As illustrated in FIG. 5, when the staple mode is selected, each of the jogger fences 53 may move from the home position thereof to the standby position at which a distance (for example, about 7 mm) is provided between the side edge of a sheet to be delivered to the edge-stapling tray F and the jogger fence 53 facing the side edge of the sheet. When the tail edge of the sheet fed by the output roller pair 11 passes the stapler output sensor 305, each of the jogger fences 53 may move by another, smaller distance (for example, about 5 mm) closer to each other from the standby position and stop.

When the stapler output sensor 305 detects that the tail edge of the sheet passes the stapler output sensor 305, the stapler output sensor 305 may send a signal to the controller 350 (depicted in FIGS. 16A and 16B). When the controller 350 receives the signal, the controller 350 may count the number of pulses output by a motor (not shown) for driving the output roller pair 11. When the number of the pulses counted reaches a reference number, the controller 350 may turn on the solenoid 170. The roller 12 may swing like a pendulum when the solenoid 170 is turned on and off. When the solenoid 170 is turned on, the roller 12 may pat the sheet to move the sheet downward. The sheet may contact the tail edge fence 51 and may be aligned by the tail edge fence 51. Whenever a sheet to be delivered to the edge-stapling tray F passes the entrance sensor 301 (depicted in FIG. 1) or the stapler output sensor 305, the entrance sensor 301 or the stapler output sensor 305 may send a signal to the controller 350. The controller 350 may count the number of sheets based on the signal.

When a reference time period elapses after the solenoid 170 is turned off, each of the jogger fences 53 may be further moved (for example, by about 2.6 mm) closer to each other and temporarily stop moving to finish aligning the sheet in the direction perpendicular to the sheet conveyance direction. Each of the jogger fences 53 may move (for example, by about 7.6 mm) away from each other to return to the standby position to become ready for aligning the next sheet. The jogger fences 53 may repeat the above-described aligning operation until the jogger fences 53 align the last sheet of a sheet stack. When the jogger fences 53 finish aligning the last sheet, each of the jogger fences 53 may move (for example, by about 7 mm) closer to each other and stop moving. Thus, the jogger fences 53 hold the both side edges of the sheet stack to become ready for a stapling operation performed by the stapler S1 (depicted in FIG. 8). When a reference time period elapses, the stapler motor 159 (depicted in FIG. 8) may drive the stapler S1 and thereby the stapler S1 staples the sheet stack. When a user specifies stapling at two or more positions, the stapler motor 159 may move the stapler S1 to a proper position along the tail edge of the sheet stack after the stapler S1 may staple the sheet stack at the first position. Thus, the stapler S1 staples the sheet stack at the second position. To staple the sheet stack at the third or succeeding position, the above-described operation may be repeated.

As illustrated in FIG. 6, when the stapling operation is finished, the controller 350 (depicted in FIG. 1) may drive the discharging motor 157 to rotate the discharging belt 52. Simultaneously, for example, the controller 350 may drive an output roller motor (not shown) to rotate the shift tray output roller pair 6 so that the shift tray output roller pair 6 receives the stapled sheet stack lifted by the discharging hook 52*a*. The jogger fences 53 may be controlled in accordance with the sheet size and the number of stapled sheets. For example, when the sheet size is smaller than the specified size or when the number of stapled sheets is smaller than the specified number, the discharging hook 52*a* may contact the tail edge of the sheet stack and lift the stapled sheet stack, while the jogger fences 53 hold the sheet stack. When a reference number of pulses are output after the sheet sensor 310 (depicted in FIG. 5) detects the sheet stack or the discharging belt sensor 311 detects the discharging hook 52*a*, each of the jogger fences 53 may move (by, for example, about 2 mm) away from each other so that the jogger fences 53 do not hold the sheet stack. The reference number of pulses may correspond to an interval between the time when the discharging hook 52*a* contacts the tail edge of the sheet stack and the time when the discharging hook 52*a* moves away from the upper ends of the jogger fences 53. When the sheet size is greater than the specified size or when the number of stapled sheets is greater than the specified number, each of the jogger fences 53 may be retreated (by, for example, about 2 mm) to discharge the sheet stack. In either case, when the sheet stack moves away from the upper ends of the jogger fences 53, each of the jogger fences 53 may further move (by, for example, about 5 mm) away from each other to the standby position so as to become ready for aligning the next sheet. A force applied by the jogger fences 53 to the sheet stack may be adjusted by changing the distance between each of the jogger fences 53 and each side edge of the sheet stack.

The following describes the magazine mode. As illustrated in FIG. 1, in the magazine mode, sheets sent from the image forming apparatus 900 may be conveyed in the conveyance paths A and D, the edge-stapling tray F, the center-stapling tray G, and the conveyance path H and may be output onto the lower tray 203. In the edge-stapling tray F, the sheets may be aligned. In the center-stapling tray G, the aligned sheets may be stapled at a position along the substantially center line of the sheets and are folded along the substantially center line of the sheets in the sheet conveyance direction. The branch nail 15 may rotate counterclockwise and the branch nail 16 may be held at the position illustrated in FIG. 1 to guide the sheets to the conveyance path D. The branch guide 54 may rotate counterclockwise and the movable guide 55 may rotate clockwise to guide the sheets to the center-stapling tray G.

For example, when the image forming apparatus 900 conveys sheets to the sheet processing apparatus 901, the sheets may be conveyed in the conveyance path A. In the conveyance path A, the branch nails 15 and 16 may guide the sheets toward the conveyance path D. In the conveyance path D, the conveying roller pairs 7, 9, and 10 and the output roller pair 11 may feed the sheets toward the edge-stapling tray F.

Figure 17:
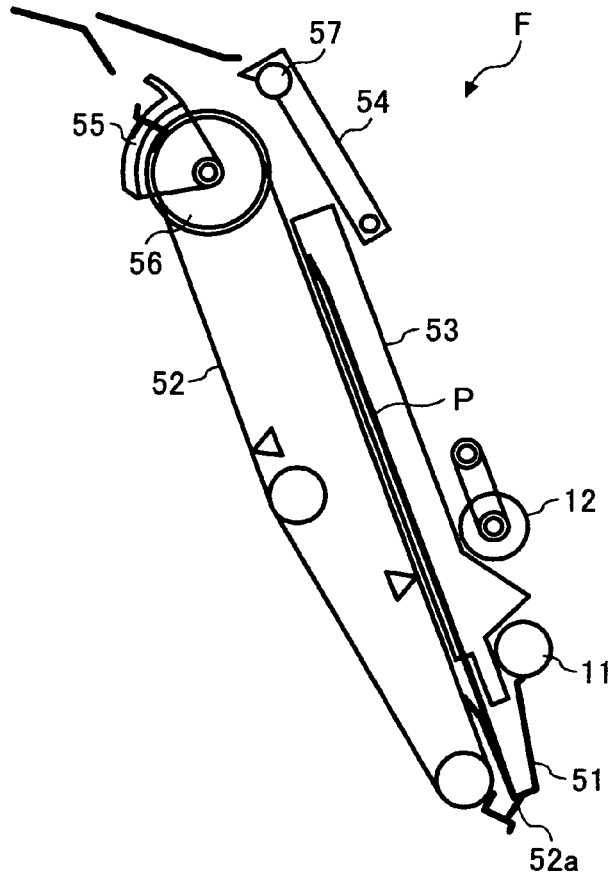
FIG. 17 is a sectional view (according to an example embodiment of the present invention) of the edge-stapling tray shown in FIG. 13 in a magazine mode.
Figure 18:
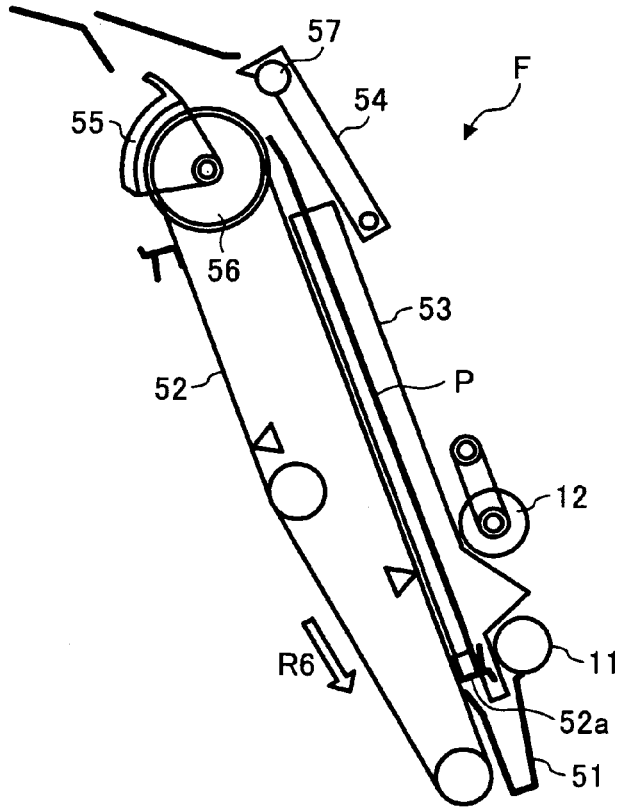
FIG. 18 is another sectional view (according to an example embodiment of the present invention) of the edge-stapling tray shown in FIG. 13 in a magazine mode.
Figure 19:
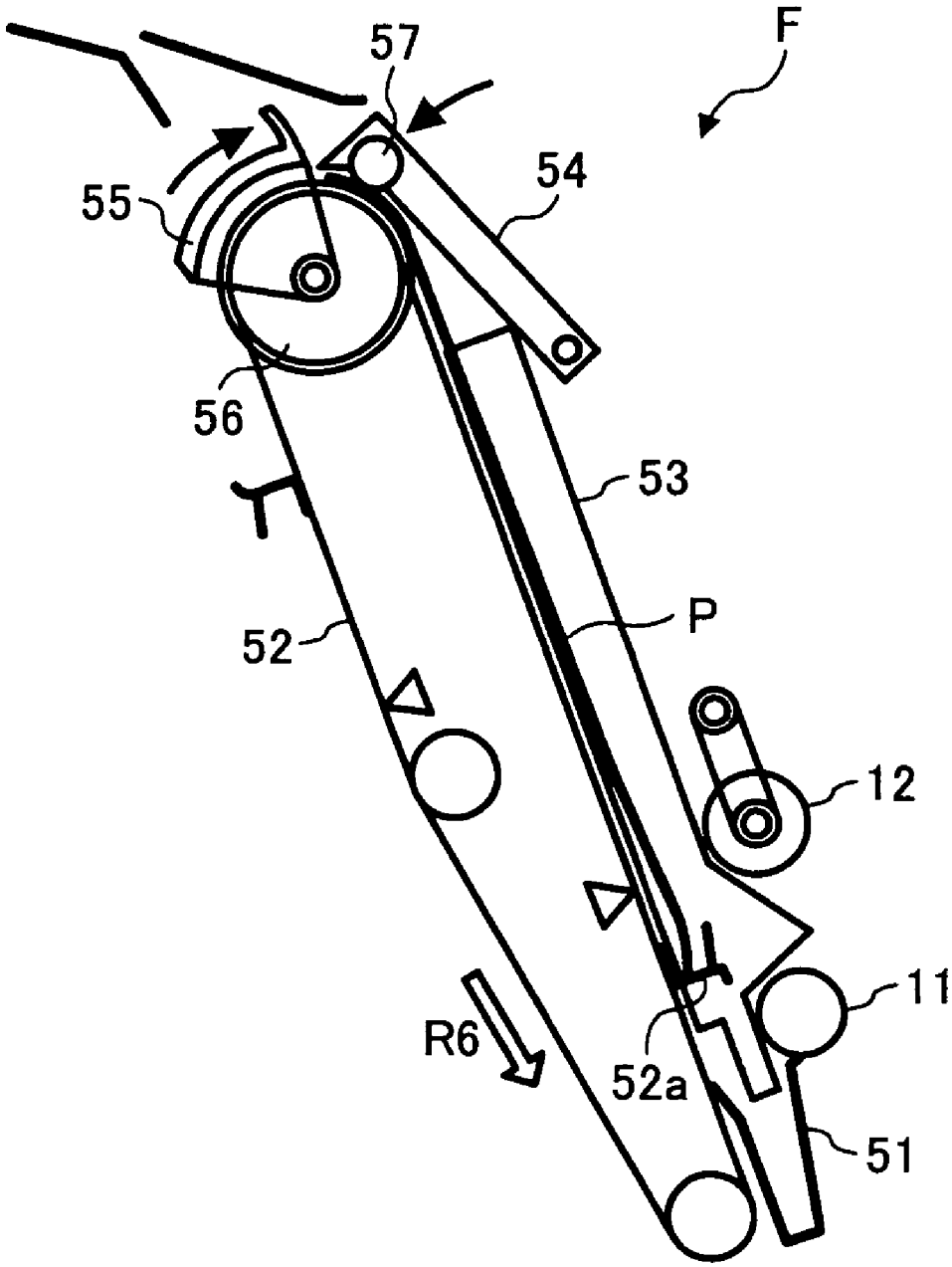
FIG. 19 is yet another sectional view (according to an example embodiment of the present invention) of the edge-stapling tray shown in FIG. 13 in a magazine mode.

As illustrated in FIG. 17, in the edge-stapling tray F, the tail edge fence 51 and the jogger fences 53 may tentatively align sheets P fed by the output roller pair 11 as described above in the staple mode. As illustrated in FIG. 18, when the sheets P are tentatively aligned, the discharging belt 52 may start rotating in a rotating direction R6. The discharging hook 52*a* may contact the tail edges of the sheets P, which contact the tail edge fence 51, and lift the sheets P. As illustrated in FIG. 19, the branch guide 54 may rotate counterclockwise and the movable guide 55 may rotate clockwise. The discharging roller 56 and the pressing roller 57 may nip the sheets P. The discharging roller 56 may be supported by a shaft (not shown) of the discharging belt 52 and thereby rotate in synchronism with the discharging belt 52. The discharging roller 56 and the discharging hook 52*a* disposed on the discharging belt 52 may further rotate to send the sheets P to the center-stapling tray G (depicted in FIG. 13) disposed downstream from the edge-stapling tray F relative to the sheet conveyance direction.

Figure 20:
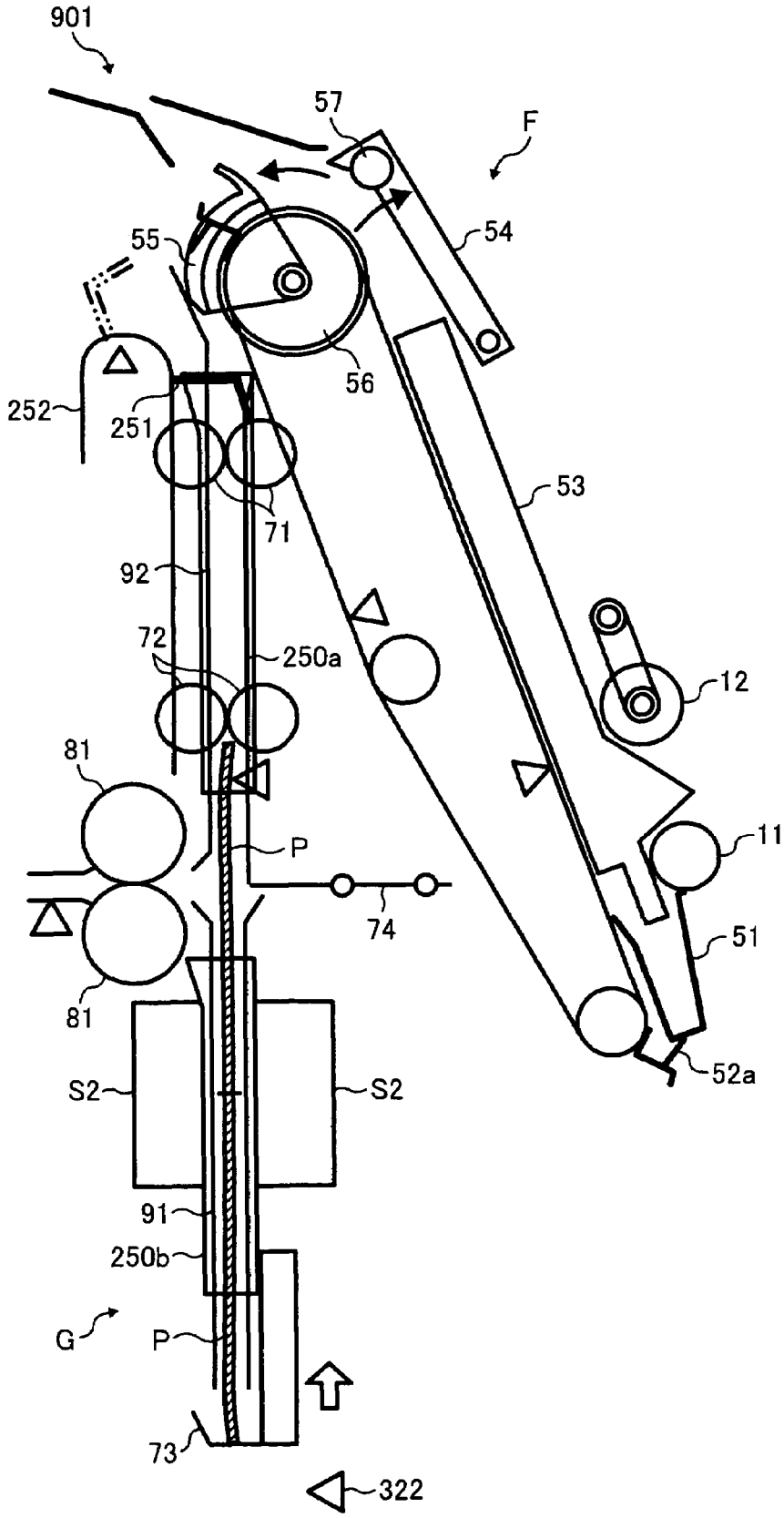
FIG. 20 is a sectional view (according to an example embodiment of the present invention) of the edge-stapling tray and the center-stapling tray shown in FIG. 13 in a magazine mode.
Figure 21:
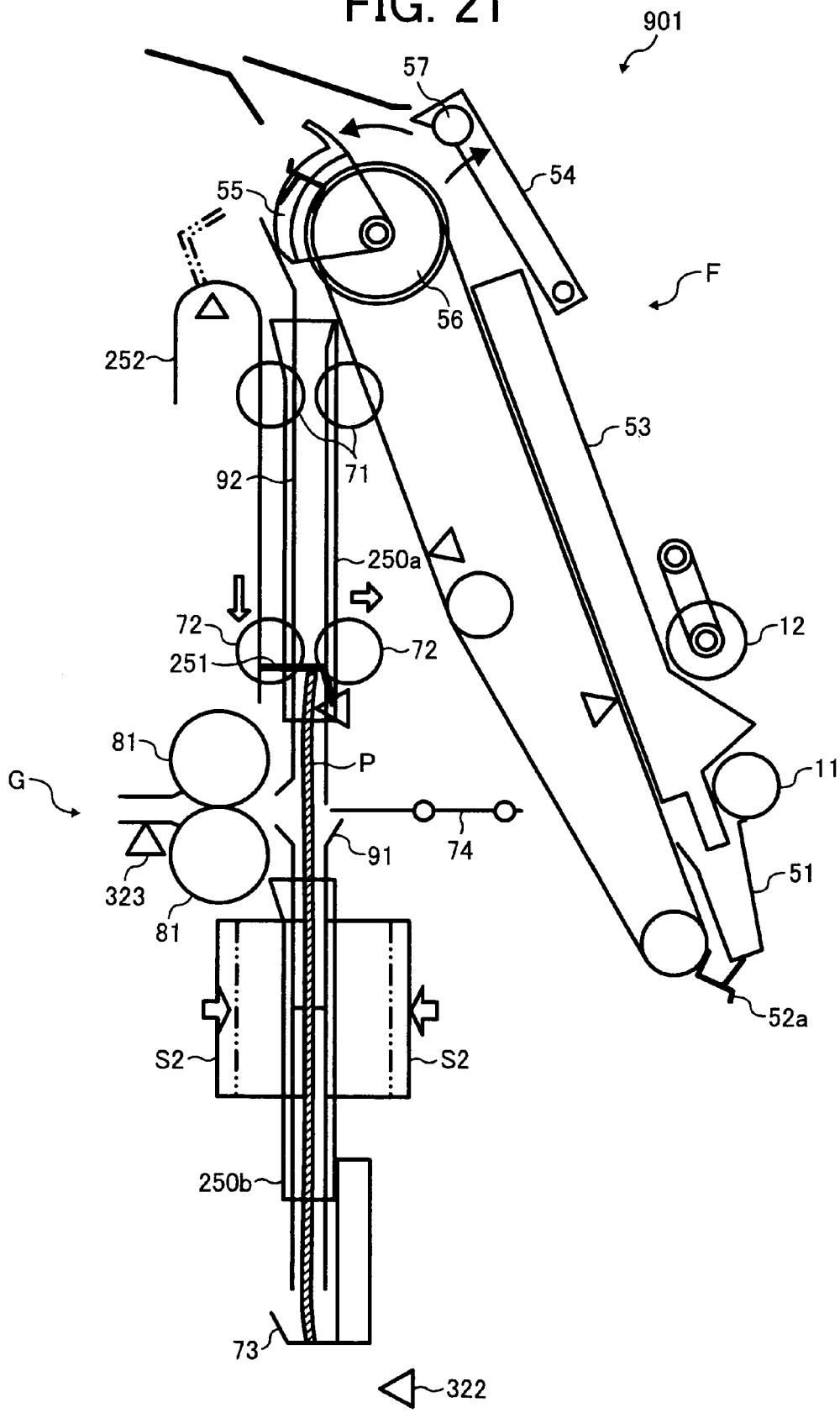
FIG. 21 is another sectional view (according to an example embodiment of the present invention) of the edge-stapling tray and the center-stapling tray shown in FIG. 13 in a magazine mode.

The discharging hook 52*a* may carry the sheets P until the tail edges of the sheets P pass the discharging roller 56. As illustrated in FIG. 20, the upper roller pair 71 and the lower roller pair 72 may feed the sheets P toward the edge fence 73. The edge fence 73 may stop at a preset stop position in accordance with information about the length of the sheets P in the sheet conveyance direction and wait for the sheets P. The information about the length of the sheets P may be specified in the image forming apparatus 900 (depicted in FIG. 16A) and may be sent to the sheet processing apparatus 901. As illustrated in FIG. 21, when the foremost edges of the sheets P in the sheet conveyance direction contact the edge fence 73, a pressure applied between the two rollers forming the lower roller pair 72 may be released. The tapper 251 may tap the tail edges of the sheets P in the sheet conveyance direction to finalize aligning the sheets P in the sheet conveyance direction. The sheets P tentatively aligned in the edge-stapling tray F may be shifted from each other while the sheets P are conveyed from the edge-stapling tray F to the center-stapling tray G. Therefore, the tapper 251 may align the sheets P.

After, for example, immediately after, the tapper 251 aligns the sheets P, the upper jogger fences 250*a* and the lower jogger fences 250*b* may finalize aligning the sheets P in the direction perpendicular to the sheet conveyance direction. The stapler S2 may staple the sheets P at a position along the substantially center line of the sheets P in the sheet conveyance direction. The edge fence 73 may be positioned based on a pulse output by the sheet sensor 322 so that the stapler S2 staples the sheets P at a position along the substantially center line of the sheets P in the sheet conveyance direction. The tapper 251 may be positioned based on a pulse output by the tapper sensor 326 (depicted in FIG. 13). The upper jogger fences 250*a* and the lower jogger fences 250*b* may perform aligning operations similar to the jogger fences 53 of the edge-stapling tray F. However, the aligning operations may be performed once after the sheets P forming a sheet stack are delivered to the center-stapling tray G and need not be performed whenever a sheet P is delivered.

Figure 22:
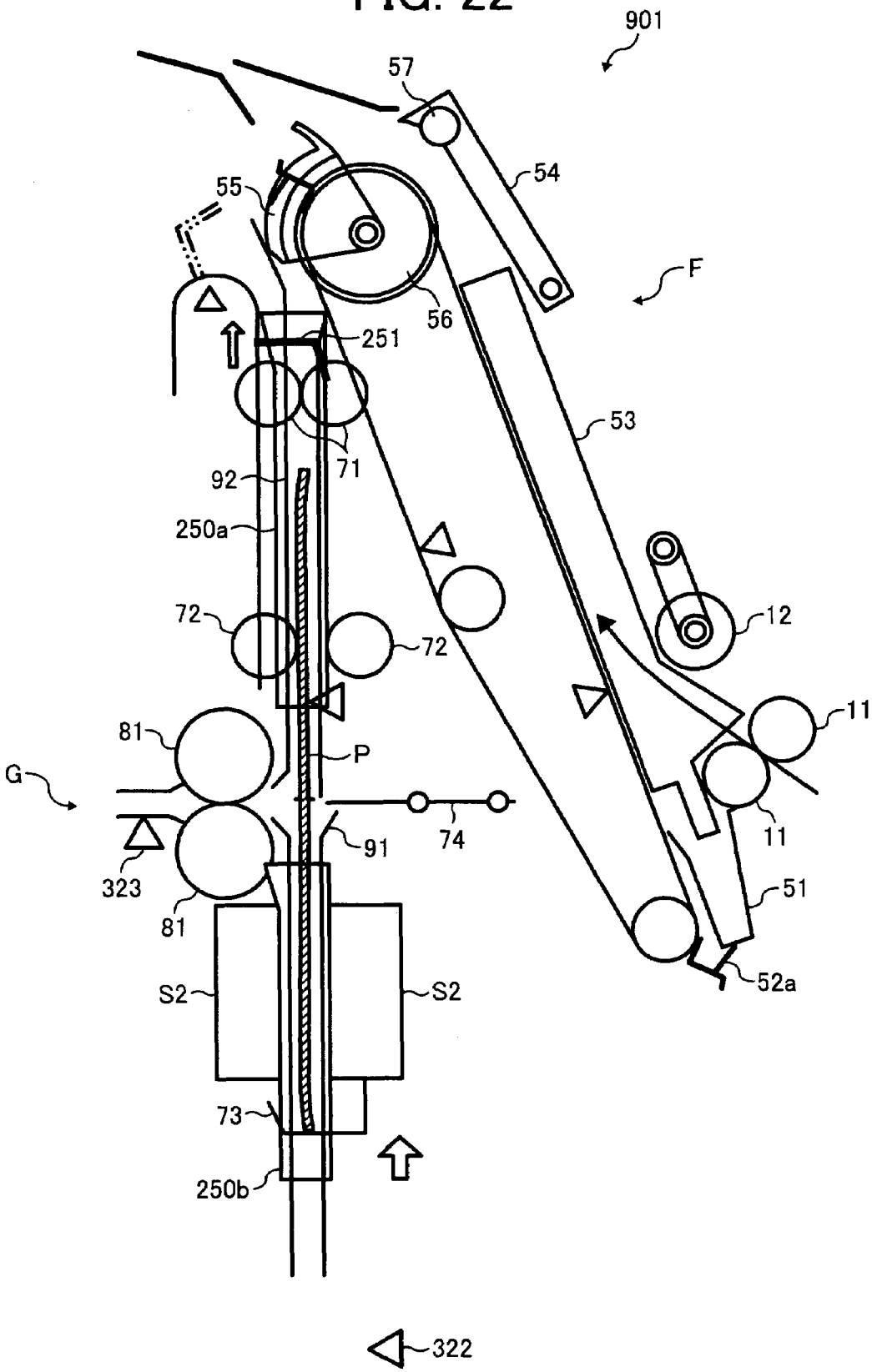
FIG. 22 is yet another sectional view (according to an example embodiment of the present invention) of the edge-stapling tray and the center-stapling tray shown in FIG. 13 in a magazine mode.

As illustrated in FIG. 22, the edge fence 73 may move upward to lift the stapled sheets P while the pressure applied by the lower roller pair 72 is released.

Figure 23:
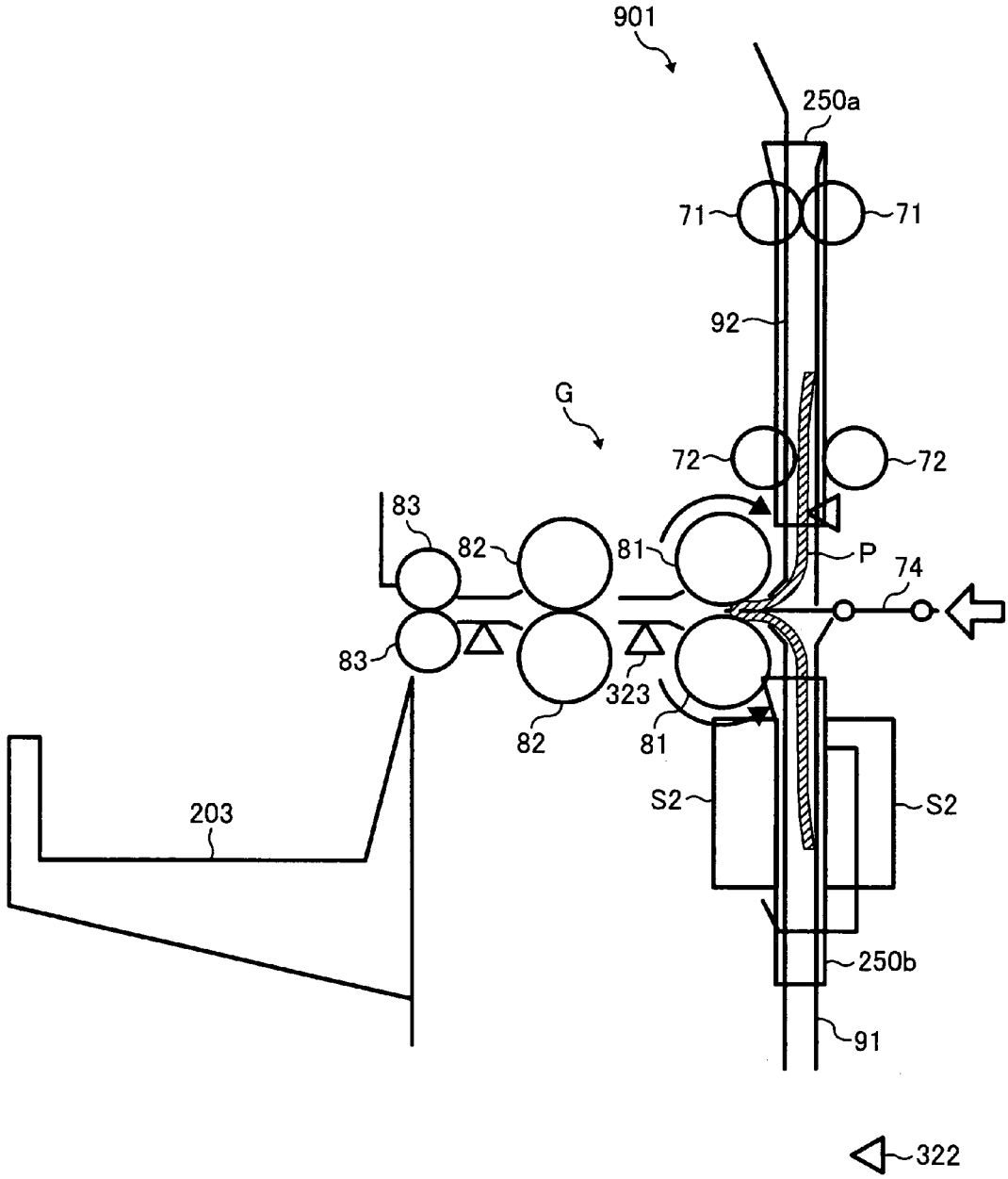
FIG. 23 is a sectional view (according to an example embodiment of the present invention) of a center portion of the center-stapling tray shown in FIG. 13 in a magazine mode.
Figure 24:
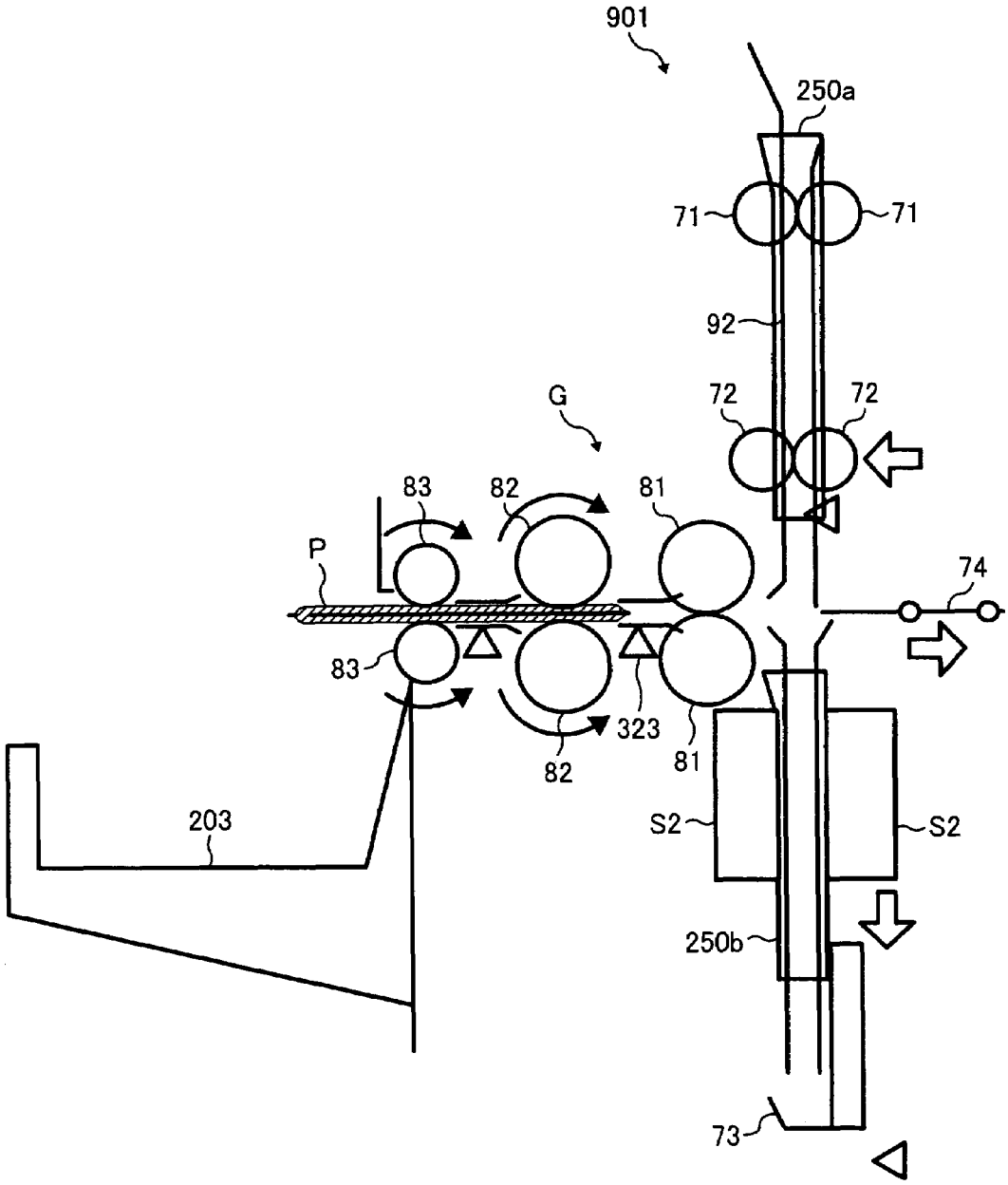
FIG. 24 is another sectional view (according to an example embodiment of the present invention) of a center portion of the center-stapling tray shown in FIG. 13 in a magazine mode.

As illustrated in FIGS. 23 and 24, the center-stapling tray G may further include a lower tray output roller pair 83. The lower tray output roller pair 83 may output the stapled sheets P onto the lower tray 203. As illustrated in FIG. 23, the fold plate 74 may push the stapled sheets P toward the fold roller pair 81 in a direction substantially perpendicular to the sheet conveyance direction at a portion on the sheets P near a staple. The fold plate 74 may further push the stapled sheets P into the nip formed by the fold roller pair 81. The rotating fold roller pair 81 may feed the stapled sheets P toward the fold roller pair 82 while the fold roller pair 81 applies a pressure to the stapled sheets P. Thus, the stapled sheets P may be folded along the substantially center line of the sheets P in the sheet conveyance direction.

As described above, the sheets P may be stapled at a position along the substantially center line of the sheets P in the sheet conveyance direction in the center-stapling tray G, instead of the edge-stapling tray F. Therefore, the stapled sheets P may be conveyed up to a fold position (e.g., the fold plate 74) by the movement of the edge fence 73 (depicted in FIG. 24) only. If the stapled sheets P are conveyed downward for a folding operation, an extra element, for example, a roller may be needed in addition to the edge fence 73 to move the stapled sheets P, resulting in a more complex structure of the sheet processing apparatus 901.

As illustrated in FIG. 24, the fold roller pair 82 may crease the stapled sheets P folded by the fold roller pair 81. The lower tray output roller pair 83 may output the stapled sheets P onto the lower tray 203. When the sheet sensor 323 detects the tail edges of the stapled sheets P in the sheet conveyance direction, each of the fold plate 74 and the edge fence 73 may return to the home position thereof. The two rollers forming the lower roller pair 72 may apply a pressure to each other to become ready for feeding the next sheets toward the edge fence 73. When the next job is performed with sheets having the size and the number of sheets common to the previous job, the edge fence 73 may move to the position illustrated in FIG. 20 again and wait for the next sheets.

As illustrated in FIG. 13, according to example embodiments, the edge-stapling tray F may tentatively aligns sheets. The tentatively aligned sheets may be sent to the center-stapling tray G disposed downstream from the edge-stapling tray F relative to the sheet conveyance direction while the sheets are not yet stapled. The center-stapling tray G may finalize aligning the sheets, and staple the sheets at a position along the substantially center line of the sheets in the sheet conveyance direction. For example, the edge-stapling tray F need not staple sheets at a position along the substantially center line of the sheets in the sheet conveyance direction. Thus, a clincher (not shown) and a driver (not shown) of the stapler S1 may be spaced from each other so that the stapler S1 staples more sheets than the stapler S2 used for stapling sheets to be folded. As a result, the clincher and the driver of the stapler S1 need not disturb the conveyance of the sheets.

The center-stapling tray G may include the upper jogger fences 250*a* and the lower jogger fences 250*b* which may accommodate up to about 15 sheets to be stapled at a position along the substantially center line of the sheets in the sheet conveyance direction. Therefore, the center-stapling tray G may reduce or prevent curling and buckling of the sheets. As a result, the sheets may not be shifted from each other and the stapler S2 may staple the sheets at a proper position on the sheets.

In the center-stapling tray G which is provided for stapling sheets at a position along the substantially center line of the sheets and for folding the sheets along the substantially center line of the sheets in the sheet conveyance direction, the stapler S2 may staple sheets to be folded, and the stapled sheets may be conveyed straight to the fold plate 74 and the fold roller pair 81 which may fold the sheets, resulting in an improved stapling and folding quality.

Sheets tentatively aligned but not stapled in the edge-stapling tray F may be conveyed from the edge-stapling tray F to the center-stapling tray G. In the center-stapling tray G, the edge fence 73 may contact the foremost edges of the sheets and the tapper 251 may tap the tail edges of the sheets so as to align the sheets in the sheet conveyance direction. The upper jogger fences 250*a* and the lower jogger fences 250*b* may contact the side edges of the sheets to align the sheets in the direction perpendicular to the sheet conveyance direction. Thus, the alignment of the sheets is finalized in the center-stapling tray G. The stapler S2 may staple the aligned sheets at a staple position along the substantially center line of the sheets in the sheet conveyance direction. The edge fence 73 may lift the sheets so that the center line of the sheets in the sheet conveyance direction is positioned at a fold position where the fold plate 74 and the fold roller pair 81 fold the sheets. For example, the edge fence 73 may move the sheets to the staple and fold positions. As a result, the sheets may be stably positioned at the staple and fold positions without being disturbed by noise.

If different fences move the sheets to the staple and fold positions respectively, the staple and fold positions may be relatively shifted from each other. However, according to example embodiments, the edge fence 73 may move the sheets to the staple and fold positions, resulting in an improved stapling and folding accuracy and a steady stapling and folding quality.

The stapler S2 may be disposed at a position lower than the fold plate 74. Therefore, after the stapler S2 staples sheets held by the edge fence 73, the edge fence 73 may move up to lift the stapled sheets to the fold position. The edge fence 73 may keep contacting the sheets while the edge fence 73 moves the sheets from the staple position to the fold position. Thus, the sheets may be easily lifted without being shifted from each other. As a result, stapling and folding operations may be performed promptly with an improved stapling and folding quality with a simpler structure.

According to example embodiments, the edge-stapling tray F may staple sheets at a position on an edge portion of the sheets. The center-stapling tray G may staple sheets at a position along the substantially center line of the sheets in the sheet conveyance direction. For example, the sheet processing apparatus 901 may staple and fold the limited number of sheets at a position along the substantially center line of the sheets in the sheet conveyance direction in the center-stapling tray G. The sheet processing apparatus 901 may also staple the large number of sheets at a position on an edge portion of the sheets in the edge-stapling tray F. Thus, the sheets may not be curled or buckled in the center-stapling tray G, resulting in an improved stapling and folding accuracy and a steady stapling and folding quality.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A sheet processing apparatus, comprising:

a conveyance path to convey sheets;

an edge-stapling tray to receive and align the sheets conveyed from the conveyance path, the edge-stapling tray includes a stapler to staple the sheets; and a center-stapling tray including a stapler, disposed downstream from the edge-stapling tray relative to a sheet conveyance direction, for stapling the sheets at a position along a substantially center line of the sheets, the center-stapling tray includes a folding member to fold the stapled sheets along the substantially center line of the sheets in the sheet conveyance direction, wherein the center-stapling tray slants at an angle such that the sheets fall along the center-stapling tray by a weight of the sheets, and the stapler is lower than the folding member.

2. The sheet processing apparatus according to claim 1, wherein the edge-stapling tray is provided upstream from the center-stapling tray relative to the sheet conveyance direction.

3. The sheet processing apparatus according to claim 1, wherein the center-stapling tray further includes a positioner to position foremost edges of the sheets in the sheet conveyance direction, the positioner downstream from the stapler relative to the sheet conveyance direction.

4. The sheet processing apparatus according to claim 3, wherein the center-stapling tray further includes an edge aligner to contact and align tail edges of the sheets in the sheet conveyance direction, the edge aligner is provided upstream from the stapler relative to the sheet conveyance direction.

5. The sheet processing apparatus according to claim 3, wherein the center-stapling tray further includes a driver to move the positioner parallel to the sheet conveyance direction and stop the positioner at a staple position at which the stapler staples the sheets and a fold position at which the folding member folds the sheets.

6. The sheet processing apparatus according to claim 1, wherein the center-stapling tray further defines a plane along which the sheets are conveyed.

7. The sheet processing apparatus according to claim 6, wherein the center-stapling tray further includes an aligner to contact side edges of the sheets to align the sheets in a direction perpendicular to the sheet conveyance direction.

8. The sheet processing apparatus according to claim 1, wherein in a staple mode, the sheet sent from an image forming apparatus is conveyed to the conveyance path, the edge-stapling tray, and an outlet conveyance path.

9. The sheet processing apparatus according to claim 1, wherein in a magazine mode, the sheet sent from an image forming apparatus is conveyed to the conveyance path, the edge-stapling tray, the center-stapling tray, and an outlet conveyance path.

10. An image forming apparatus, comprising:

a first conveyance path to convey sheets; and a sheet processing apparatus, including a second conveyance path to further convey the sheets conveyed from the first conveyance path, and an edge-stapling tray to receive and align the sheets conveyed from the second conveyance path, the edge-stapling tray includes a stapler to staple the sheets; and a center-stapling tray including a stapler, disposed downstream from the edge-stapling tray relative to a sheet conveyance direction, for stapling the sheets at a position along a substantially center line of the sheets, the center-stapling tray includes a folding member to fold the stapled sheets along the substantially center line of the sheets in the sheet conveyance direction, wherein the center-stapling tray slants at an angle such that the sheets fall along the center-stapling tray by a weight of the sheets, and the stapler is provided at a position lower than the folding member.

11. The image forming apparatus according to claim 10, wherein the edge-stapling tray is provided upstream from the center-stapling tray relative to the sheet conveyance direction.

12. The image forming apparatus according to claim 10, wherein the center-stapling tray further includes a positioner to position foremost edges of the sheets in the sheet conveyance direction, the positioner downstream from the stapler relative to the sheet conveyance direction.

13. The image forming apparatus according to claim 12, wherein the center-stapling tray further includes an edge aligner to contact and align tail edges of the sheets in the sheet conveyance direction, the edge aligner is provided upstream from the stapler relative to the sheet conveyance direction.

14. The image forming apparatus according to claim 12, wherein the center-stapling tray further includes a driver to move the positioner in parallel to the sheet conveyance direction and stop the positioner at a staple position at which the stapler staples the sheets and a fold position at which the folding member folds the sheets.

15. The image forming apparatus according to claim 10, wherein the center-stapling tray further defines a plane along which the sheets are conveyed.

16. The image forming apparatus according to claim 15, wherein the center-stapling tray further includes an aligner to contact side edges of the sheets to align the sheets in a direction perpendicular to the sheet conveyance direction.

* * * * *